US010103467B2

(12) United States Patent
Hayashi

(10) Patent No.: US 10,103,467 B2
(45) Date of Patent: Oct. 16, 2018

(54) LIQUID DISCHARGE APPARATUS AND FLEXIBLE FLAT CABLE GROUPING

(71) Applicant: SEIKO EPSON CORPORATION, Tokyo (JP)

(72) Inventor: Hiroki Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/361,969

(22) Filed: Nov. 28, 2016

(65) Prior Publication Data

US 2017/0173951 A1 Jun. 22, 2017

(30) Foreign Application Priority Data

Dec. 22, 2015 (JP) ..... 2015-249776

(51) Int. Cl.

| | |
|---|---|
| ***H01R 12/77*** | (2011.01) |
| ***B41J 2/045*** | (2006.01) |
| *B41J 2/14* | (2006.01) |
| *H01R 12/79* | (2011.01) |

(52) U.S. Cl.

CPC ..... *H01R 12/77* (2013.01); *B41J 2/04541* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14491* (2013.01); *H01R 12/79* (2013.01)

(58) Field of Classification Search

CPC ..... B41J 2/04541; B41J 2/04581; B41J 2/04588; B41J 2/04593; B41J 2/04596; B41J 2/14233

See application file for complete search history.

(56) References Cited

U.S. PATENT DOCUMENTS

| | | | | |
|---|---|---|---|---|
| 2006/0197809 | A1* | 9/2006 | Tobita | B41J 2/14274 347/71 |
| 2006/0238558 | A1 | 10/2006 | Hatasa et al. | |
| 2010/0002057 | A1 | 1/2010 | Hatasa et al. | |
| 2012/0274688 | A1* | 11/2012 | Okada | B41J 2/04581 347/10 |

FOREIGN PATENT DOCUMENTS

| | | | |
|---|---|---|---|
| JP | 2006-297826 | A | 11/2006 |
| JP | 2007-038489 | A | 2/2007 |
| JP | 2007-055184 | A | 3/2007 |
| JP | 2007-313831 | A | 12/2007 |
| JP | 2009-023168 | A | 2/2009 |
| JP | 2013-248755 | A | 12/2013 |
| JP | 2014-004767 | A | 1/2014 |

* cited by examiner

*Primary Examiner* — Lamson Nguyen

(57) ABSTRACT

A liquid discharge apparatus is provided with a first flexible flat cable, a second flexible flat cable, a head unit, and a liquid absorbing member, the head unit includes discharge section which discharges a liquid due to driving signals being applied, a discharge surface which is provided with a discharge opening for discharging the liquid, a first connection section which is connected to the first flexible flat cable, and a second connection section which is connected to the second flexible flat cable, and the liquid absorbing member is provided between the first flexible flat cable and the second flexible flat cable.

33 Claims, 17 Drawing Sheets

| (SIH-i, SIL-i) | T1 | | T2 | | SP-1～SP-16 |
|---|---|---|---|---|---|
| | Sa-i | Sb-i | Sa-i | Sb-i | |
| (1, 1) [LARGE DOT] | H | L | H | L | SP-1～SP-4=(1, 0, 1, 0) |
| (1, 0) [MEDIUM DOT] | H | L | L | H | SP-5～SP-8=(1, 0, 0, 1) |
| (0, 1) [SMALL DOT] | L | L | L | H | SP-9～SP-12=(0, 0, 0, 1) |
| (0, 0) [NO RECORDING] | L | H | L | L | SP-13～SP-16=(0, 1, 0, 0) |
Fig. 11
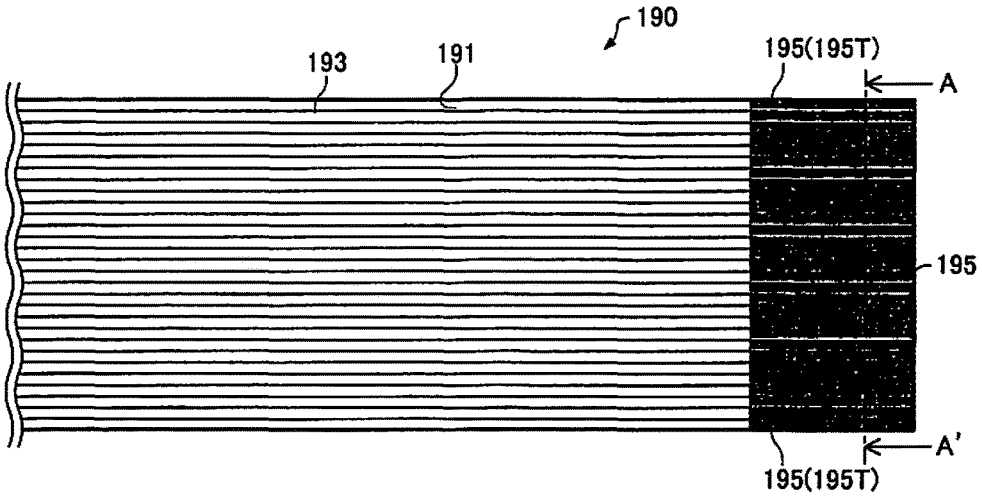
Fig. 12A
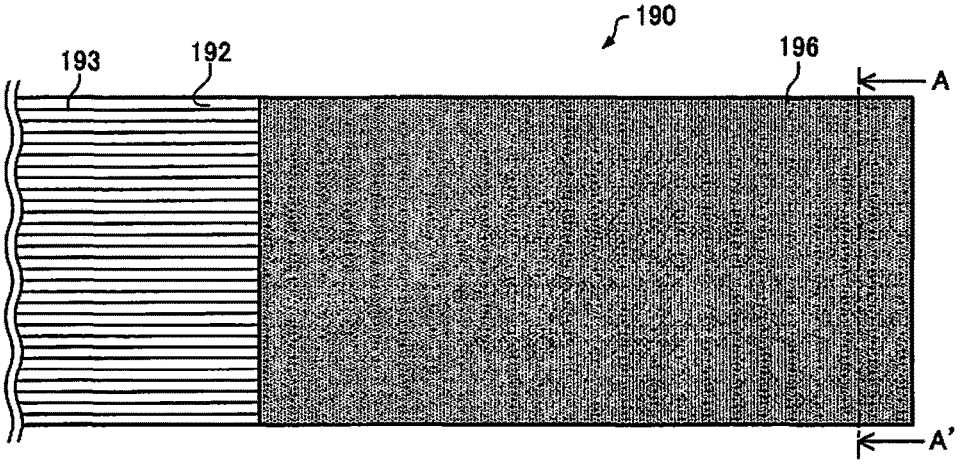
Fig. 12B

| TERMINAL NUMBER | SIGNAL NAME |
|---|---|
| 1 | GND |
| 2 | Sck |
| 3 | GND |
| 4 | Data |
| 5 | GND |
| 6 | LAT |
| 7 | GND |
| 8 | CH |
| 9 | GND |
| 10 | COM-A |
| 11 | VBS |
| 12 | COM-B |
| 13 | VBS |
| 14 | COM-A |
| 15 | VBS |
| 16 | COM-B |
| 17 | VBS |
| 18 | COM-A |
| 19 | VBS |
| 20 | COM-B |
| 21 | VBS |
| 22 | CH |
| 23 | GND |
| 24 | LAT |
| 25 | GND |
| 26 | Data |
| 27 | GND |
| 28 | Sck |
| 29 | GND |

Fig. 17

LIQUID DISCHARGE APPARATUS AND FLEXIBLE FLAT CABLE GROUPING

CROSS-REFERENCE TO RELATED APPLICATIONS

This application claims priority to Japanese Patent Application No. 2015-249776 filed on Dec. 22, 2015. The entire disclosure of Japanese Patent Application No. 2015-249776 is hereby incorporated herein by reference.

BACKGROUND

Technical Field

The present invention relates to a liquid discharge apparatus and a flexible flat cable grouping.

Related Art

Among liquid discharge apparatuses such as ink jet printers which print images and text by discharging ink, there are liquid discharge apparatuses which use piezoelectric elements (for example, piezo elements). The piezoelectric elements are provided so as to correspond to each of a plurality of discharge sections in a head unit and dots are formed on a medium such as paper by a specific amount of ink (liquid) being discharged from nozzles at specific timings due to the piezoelectric elements being driven in accordance with driving signals. A phenomenon has been confirmed where, although most of the liquid which is discharged lands on the medium and remains on the medium, a portion of the liquid which is discharged may become mist before landing on the medium and is suspended in the air. In addition, another phenomenon has been confirmed where, by being re-suspended due to an air flow which is generated by a carriage which moves above the medium and the medium which is being transported, the liquid which lands on the medium may also become mist before solidified by being absorbed into the medium. The mist which is suspended in this manner becomes attached to various sections inside the casing, but it is particularly easy for the mist to become attached to the surface of a plurality of cables (a cable grouping) which electrically connects an electrical circuit substrate (a main substrate) which is on the main body side and an electrical circuit substrate (a head substrate) which is on the discharge section side which discharges liquid. Examples of reasons for it being easy for the mist to become attached to the surface of the cable are that there are states where it is easy for the mist to become adhered due to a signal line which is provided in the cable transferring driving signals with high voltages, static electricity being generated due to the cable rubbing against various sections inside the casing in liquid discharge apparatuses where the carriage is driven, and the like. The more the liquid discharge apparatus is operated continuously over a long period of time, the mist which becomes adhered to the surface of the cable condenses, forms droplets, and gathers at the end sections of the cable due to vibrations which are generated by the discharge operations and the medium transport operations.

One end of the cable is connected to the head substrate and the other end of the cable is connected to the main substrate as described above, but once attached to the surface of the substrate, it is easy for the liquid to remain at the connection section of the head substrate and the cable due to the positional relationship between the cable and the head substrate. The connection section is not covered for convenience so that the signal line inside the cable and the substrate are electrically connected. Accordingly, when liquid gets into the connection section, an unsuitable electrical connection relationship is established via the liquid between the substrate and the signal line which is provided in the cable and various types of electrical faults including short circuiting are generated. The various types of electrical faults are when high voltages are applied to circuits which operate using low voltages such as logic circuits and when there is short circuiting of a ground line and other various types of signal lines, and there are cases where circuits in inner sections of the head unit are damaged when electrical faults are generated in this manner.

With regard to such problems, Japanese Patent Application Publication No. 2014-4767 discloses a cover member being provided with the objective of preventing ink mist from entering into inner sections of the head unit. In addition, Japanese Patent Application Publication No. 2007-313831 discloses the connection section being sealed in order to prevent liquid becoming attached to electrode sections. In addition, Japanese Patent Application Publication No. 2009-23168 discloses a cable cover section being provided on the head side in order to prevent ink mist from entering into the connection section. In addition, Japanese Patent Application Publication No. 2013-248755 discloses an ink absorption layer being provided with the objective of preventing ink mist from entering into inner sections of the head unit.

However, none of the above-cited documents considers the configuration of the cable grouping or the structuring of the connection between the head unit and the cable grouping, and there is scope for improvement in order to effectively suppress electrical faults which are caused by liquid which is discharged.

SUMMARY

The present invention takes into consideration the problems as above and is able to propose a liquid discharge apparatus and flexible flat cable grouping as in several aspects of the present invention so that it is possible to effectively suppress electrical faults which are caused by liquid which is discharged.

The present invention is carried out in order to solve at least a portion of the problems described above and is able to be realized by the following aspects and applied examples.

A liquid discharge apparatus as in an applied example is provided with a first flexible flat cable, a second flexible flat cable, a head unit, and a liquid absorbing member, wherein the head unit includes a discharge section which discharges a liquid due to driving signals being applied, a discharge surface which is provided with a discharge opening for discharging the liquid, a first connection section which is connected to the first flexible flat cable, and a second connection section which is connected to the second flexible flat cable, and the liquid absorbing member is provided between the first flexible flat cable and the second flexible flat cable.

In the liquid discharge apparatus as in this applied example, the liquid which becomes attached to the first flexible flat cable and the second flexible flat cable and flows in the direction of the first connection section and the second connection section of the head unit is absorbed by the liquid absorbing member which is provided between the first flexible flat cable and the second flexible flat cable. Accordingly, according to the liquid discharge apparatus as in this applied example, it is possible to protect the head unit from the liquid using the liquid absorbing member and to effectively suppress electrical faults which are caused by the liquid which is discharged.

In the liquid discharge apparatus as in the applied example described above, each of the first flexible flat cable and the second flexible flat cable may include a first surface, a second surface which is on the reverse side of the first surface, a driving signal line which transfers the driving signals, and a driving signal output terminal which is provided in the first surface and which outputs the driving signals to the head unit, the first surface of the first flexible flat cable and the first surface of the second flexible flat cable may oppose each other, and the liquid absorbing member may be provided between the first surface of the first flexible flat cable and the first surface of the second flexible flat cable.

In the liquid discharge apparatus as in this applied example, the liquid which becomes attached to the first surface of the first flexible flat cable and the first surface of the second flexible flat cable and flows in the direction of the first connection section and the second connection section of the head unit is absorbed by the liquid absorbing member which is provided between the first surface of the first flexible flat cable and the first surface of the second flexible flat cable. Then, it is difficult for the liquid to become attached to the driving signal output terminal in the first flexible flat cable and the second flexible flat cable due to the functioning of the liquid absorbing member since the driving signal output terminal is provided in the first surface and it is difficult for electrical faults such as short circuiting, which are generated due to the liquid being attached to the driving signal output terminal, to be generated. Accordingly, according to the liquid discharge apparatus as in this applied example, it is possible to protect the discharge signal output terminal from the liquid using the liquid absorbing member and to effectively suppress electrical faults which are caused by the liquid which is discharged.

In the liquid discharge apparatus as in the applied example described above, the head unit may include a discharge selecting section which selects the discharge section which is to discharge the liquid by receiving control signals, and each of the first flexible flat cable and the second flexible flat cable may include a control signal line which transfers the control signals and a control signal output terminal which is provided in the first surface and which outputs the control signals to the head unit.

In the liquid discharge apparatus as in this applied example, it is difficult for the liquid to become attached to the control signal output terminal in the first flexible flat cable and the second flexible flat cable due to the functioning of the liquid absorbing member since the control signal output terminal is provided in the first surface and it is difficult for electrical faults such as short circuiting, which are generated due to the liquid being attached to the control signal output terminal, to be generated. Accordingly, according to the liquid discharge apparatus as in this applied example, it is possible to protect the control signal output terminal from the liquid using the liquid absorbing member and to effectively suppress electrical faults which are caused by the liquid which is discharged.

The liquid discharge apparatus as in the applied example described above may include a binding section for binding the first flexible flat cable and the second flexible flat cable.

In the liquid discharge apparatus as in this applied example, the first flexible flat cable and the second flexible flat cable are brought into contact by the binding section and it is difficult for liquid to enter into the contacting portion. In addition, it is difficult for the liquid which is attached to the side, which is farthest from the contacting portion with regard to the head section in the first surfaces of the first flexible flat cable and the second flexible flat cable, to pass through the contacting portion. Even if liquid were able to pass through the contacting portion in the first surfaces of the first flexible flat cable and the second flexible flat cable or liquid were to become directly attached to between the binding section and the liquid absorbing member, the liquid would be absorbed by the liquid absorbing member. Furthermore, generation of static electricity due to rubbing of the flexible flat cables is suppressed since the first flexible flat cable and the second flexible flat cable are bound together by the binding section. As a result, it is difficult for liquid to become attached to the first flexible flat cable and the second flexible flat cable, and it is possible to suppress the effects on the head unit due to static electricity which is generated by the first flexible flat cable and the second flexible flat cable. Accordingly, according to the liquid discharge apparatus as in this applied example, it is possible to effectively suppress electrical faults which are caused by the liquid which is discharged and electrical faults which are caused by static electricity which is generated by the first flexible flat cable and the second flexible flat cable.

In the liquid discharge apparatus as in the applied example described above, the first flexible flat cable may be connected to the first connection section so that the second surface faces toward the same side as the discharge surface.

In the liquid discharge apparatus as in this applied example, in the first connection section of the head unit, the second surface of the first flexible flat cable is on the same side as the discharge opening for the liquid and the first surface of the first flexible flat cable is on the opposite side to the discharge opening for the liquid. In other words, the second surface is positioned in the first connection section of the head unit between the discharge surface and the first surface of the first flexible flat cable in a direction which is orthogonal to the discharge surface of the head unit. That is, since the first flexible flat cable is connected to the first connection section of the head unit so that the second surface opposes a medium and the first surface does not oppose the medium, there is a tendency for it to be easy for a portion of the liquid which is discharged from the discharge opening toward the medium to become attached to the second surface and for it to be difficult for the liquid to become attached to the first surface. In addition, even if liquid were to become attached to the first surface of the first flexible flat cable, the liquid would be absorbed by the liquid absorbing member. Accordingly, according to the liquid discharge apparatus as in this applied example, it is possible to more effectively suppress electrical faults which are caused by the liquid which is discharged.

In the liquid discharge apparatus as in the applied example described above, the first flexible flat cable may be connected to the first connection section so that it is easier for mist, which is generated in accompaniment with the liquid being discharged from the discharge opening, to become attached to the second surface than to the first surface.

In the liquid discharge apparatus as in this applied example, it is difficult for liquid to become attached to the first surface of the first flexible flat cable, and even if liquid were to become attached, the liquid would be absorbed by the liquid absorbing member. Accordingly, according to the liquid discharge apparatus as in this applied example, it is possible to more effectively suppress electrical faults which are caused by the liquid which is discharged.

The liquid discharge apparatus as in the applied example described above may be provided with a plurality of flexible flat cables which include the first flexible flat cable and the second flexible flat cable, the head unit may include a plurality of connection sections which include the first connection section and the second connection section, the plurality of flexible flat cables may be respectively connected to the plurality of connection sections, and the first connection section may be the closest out of the plurality of connection sections to the discharge surface.

In the liquid discharge apparatus as in this applied example, it is difficult for liquid to become attached to the first surface which is on the opposite side to the discharge opening in the first flexible flat cable where it is easier for liquid which is discharged from the discharge surface to become attached since the first flexible flat cable is connected to the first connection section is the closest out of the plurality of connection sections of the head unit to the discharge surface. In addition, even if liquid were to become attached to the first surface of the first flexible flat cable, the liquid would be absorbed by the liquid absorbing member. Accordingly, according to the liquid discharge apparatus as in this applied example, it is possible to more effectively suppress electrical faults which are caused by the liquid which is discharged.

In the liquid discharge apparatus as in the applied example described above, the first flexible flat cable may include a reinforcing plate which is provided on the second surface.

In the liquid discharge apparatus as in this applied example, the progress of the liquid, which becomes attached to the second surface of the first flexible flat cable, toward the first connection section of the head unit is impeded by the reinforcing plate which reinforces the first flexible flat cable. Accordingly, according to the liquid discharge apparatus as in this applied example, it is possible to effectively suppress electrical faults which are caused by the liquid which is discharged since the reinforcing plate which is provided on the second surface of the first flexible flat cable also acts as a member for preventing entry of the liquid into the head unit.

In the liquid discharge apparatus as in the applied example described above, the reinforcing plate may have an ability to repeal water which is greater than the second surface of the first flexible flat cable.

In the liquid discharge apparatus as in this applied example, even if the liquid which is discharged from the discharge section becomes attached, it is easy for the liquid to fall downward before reaching the first connection section of the head unit due to the ability of the reinforcing plate to repeal water. Accordingly, according to the liquid discharge apparatus as in this applied example, it is possible to prevent entry of the liquid into the head unit using the reinforcing plate and it is possible to effectively suppress electrical faults.

In the liquid discharge apparatus as in the applied example described above, the reinforcing plate need not have grooves.

In the liquid discharge apparatus as in this applied example, since there are no grooves in the reinforcing plate, the liquid which becomes attached to the reinforcing plate is not led towards the first connection section of the head unit along the grooves and it is easy for the liquid to fall downward before reaching the first connection section. Accordingly, according to the liquid discharge apparatus as in this applied example, it is possible to prevent entry of the liquid into the head unit using the reinforcing plate and it is possible to effectively suppress electrical faults.

In the liquid discharge apparatus as in the applied example described above, at least one of the first flexible flat cable and the second flexible flat cable may include a short circuit detecting terminal which is provided in the first surface in order to detect short circuiting.

In the liquid discharge apparatus as in this applied example, it is possible for short circuiting to be detected using the short circuit detecting terminal in a case of short circuiting due to the liquid being attached to the first surface of the first flexible flat cable.

The liquid discharge apparatus as in the applied example described above may be provided with a short circuit detecting section which detects short circuiting based on the short circuit detecting terminal, and supply of the driving signals to the head unit may be stopped when the short circuit detecting section detects the short circuiting.

According to the liquid discharge apparatus as in this applied example, since the driving signals with high voltages are no longer supplied to the head unit in a case where the short circuit detecting section detects the short circuiting, it is possible to suppress erroneous discharge and malfunctioning of circuits in inner sections of the head unit.

In the liquid discharge apparatus as in the applied example described above, supply of the control signals to the head unit may be stopped when the short circuit detecting section detects the short circuiting.

According to the liquid discharge apparatus as in this applied example, since the control signals are no longer supplied to the head unit is stopped in a case where the short circuit detecting section detects the short circuiting, it is possible to suppress erroneous discharge and malfunctioning of circuits in inner sections of the head unit.

In the liquid discharge apparatus as in the applied example described above, the first flexible flat cable and the second flexible flat cable may include a plurality of signal lines, and the driving signal line may be a signal line out of the plurality of signal lines other than the signal lines which are positioned on the ends.

According to the liquid discharge apparatus as in this applied example, since the driving signal line which transfers driving signals with high voltages is the signal line other than the signal lines which are positioned on the ends where it is easy for the liquid which becomes attached to the first flexible flat cable and the second flexible flat cable to gather, it is possible to effectively suppress damage to circuits in inner sections of the head unit which are due to short circuiting of the driving signal line.

In the liquid discharge apparatus as in the applied example described above, the signal lines which are positioned on the ends may be ground lines.

In the liquid discharge apparatus as in this applied example, since the ground lines with low voltages are positioned at the ends where it is easy for the liquid which becomes attached to the first flexible flat cable and the second flexible flat cable to gather, it is possible for the effect on the circuits in inner sections of the head unit to be reduced even if there were to be short circuiting of the ground line.

In the liquid discharge apparatus as in the applied example described above, a signal line which transfers a signal with a voltage which is lower than the driving signal may be provided between the driving signal line and the signal lines which are positioned at the ends.

According to the liquid discharge apparatus as in this applied example, since another signal line is provided in the first flexible flat cable and the second flexible flat cable between the driving signal line and the signal lines which are positioned at the ends, it is difficult for there to be short circuiting of the driving signal line and it is possible to effectively suppress damage to circuits in inner sections of the head unit. Furthermore, since the signal line, which is provided between the driving signal line and the signal lines which are positioned at the ends, transfers a signal with a voltage which is lower than the driving signal, it is possible for the effect on the circuits in inner sections of the head unit to be reduced even if there were to be short circuiting of the signal lines which are positioned at the ends.

In the liquid discharge apparatus as in the applied example described above, the driving signal output terminal need not be provided in the second surface of the first flexible flat cable and the second surface of the second flexible flat cable.

According to the liquid discharge apparatus as in this applied example, since the driving signal output terminal is not provided in the second surface of the first flexible flat cable and the second surface of the second flexible flat cable, it is difficult for electrical faults such as short circuiting of the driving signal output terminal, which are due to the liquid which becomes attached to the second surfaces, to be generated. Accordingly, according to the liquid discharge apparatus as in this applied example, it is possible to effectively suppress electrical faults which are caused by the liquid which is discharged.

In the liquid discharge apparatus as in the applied example described above, the head unit may discharge the liquid while sliding.

In the liquid discharge apparatus as in this applied example, a portion of the liquid which lands on the medium is turned into mist and becoming suspended due to an air flow which is generated by the head unit sliding, and it is easy for more of the mist to become attached to the first flexible flat cable and the second flexible flat cable due to static electricity which is generated by the first flexible flat cable and the second flexible flat cable rubbing against various sections. In addition, due to the first flexible flat cable and the second flexible flat cable swaying in accompaniment with the sliding of the head unit, it is easy for the mist which becomes attached to condense, become droplets, and flow in the direction of the first connection section and the second connection section of the head unit. Accordingly, according to the liquid discharge apparatus as in this applied example, although it is easy for electrical faults which are caused by the mist to be generated, it is difficult for electrical faults to be generated since the liquid is absorbed by the liquid absorbing member which is provided between the first flexible flat cable and the second flexible flat cable.

A flexible flat cable grouping as in an applied example is connected to a first connection section and a second connection section of a head unit which includes a discharge section which discharges a liquid due to driving signals being applied, a discharge surface which is provided with a discharge opening for discharging the liquid, the first connection section, and the second connection section, the flexible flat cable grouping includes a first flexible flat cable, a second flexible flat cable, and a liquid absorbing member, and the liquid absorbing member is provided between the first flexible flat cable and the second flexible flat cable.

In the flexible flat cable grouping as in this applied example, the liquid which becomes attached to the first flexible flat cable and the second flexible flat cable and flows in the direction of the first connection section and the second connection section of the head unit is absorbed by the liquid absorbing member which is provided between the first flexible flat cable and the second flexible flat cable. Accordingly, according to the flexible flat cable grouping as in this applied example, it is possible to protect the head unit from the liquid using the liquid absorbing member and to effectively suppress electrical faults which are caused by the liquid which is discharged.

In the flexible flat cable grouping as in the applied example described above, each of the first flexible flat cable and the second flexible flat cable may include a first surface, a second surface which is on the reverse side of the first surface, a driving signal line which transfers the driving signals, and a driving signal output terminal which is provided in the first surface and which outputs the driving signals to the head unit, the first surface of the first flexible flat cable and the first surface of the second flexible flat cable may oppose each other, and the liquid absorbing member may be provided between the first surface of the first flexible flat cable and the first surface of the second flexible flat cable.

In the flexible flat cable grouping as in the applied example described above, each of the first flexible flat cable and the second flexible flat cable may include a control signal line which transfers control signals for controlling a discharge selecting section, which is included in the head unit and which selects the discharge section which is to discharge the liquid, and a control signal output terminal which is provided in the first surface and which outputs the control signals to the head unit.

The flexible flat cable grouping as in the applied example described above may include a binding section for binding the first flexible flat cable and the second flexible flat cable.

In the flexible flat cable grouping as in the applied example described above, the first flexible flat cable may be connected to the first connection section so that the second surface faces toward the same side as the discharge surface.

In the flexible flat cable grouping as in the applied example described above, the first flexible flat cable may be connected to the first connection section so that it is easier for mist, which is generated in accompaniment with the liquid being discharged from the discharge opening, to become attached to the second surface than to the first surface.

In the flexible flat cable grouping as in the applied example described above, the first flexible flat cable may be connected to the connection section which is the closest, out of a plurality of connection sections which are included in the head unit and which include the first connection section and the second connection section, to the discharge surface.

In the flexible flat cable grouping as in the applied example described above, the first flexible flat cable may include a reinforcing plate which is provided on the second surface.

In the flexible flat cable grouping as in the applied example described above, the reinforcing plate may have an ability to repeal water which is greater than the second surface of the first flexible flat cable.

In the flexible flat cable grouping as in the applied example described above, the reinforcing plate need not have grooves.

In the flexible flat cable grouping as in the applied example described above, at least one of the first flexible flat cable and the second flexible flat cable may include a short circuit detecting terminal which is provided in the first surface in order to detect short circuiting.

In the flexible flat cable grouping as in the applied example described above, the first flexible flat cable and the second flexible flat cable may include a plurality of signal lines and the driving signal line may be a signal line out of the plurality of signal lines other than the signal lines which are positioned on the ends.

In the flexible flat cable grouping as in the applied example described above, the signal lines which are positioned on the ends may be ground lines.

In the flexible flat cable grouping as in the applied example described above, a signal line which transfers a signal with a voltage which is lower than the driving signal may be provided between the driving signal line and the signal lines which are positioned at the ends.

In the flexible flat cable grouping as in the applied example described above, the driving signal output terminal need not be provided in the second surface of the first flexible flat cable and the second surface of the second flexible flat cable.

BRIEF DESCRIPTION OF THE DRAWINGS

Referring now to the attached drawings which form a part of this original disclosure:

FIG. 11 is a diagram illustrating a table which shows the decoding logic of a decoder.

FIG. 12A is a planar diagram of a first surface of a flexible flat cable.

FIG. 12B is a planar diagram of a second surface of a flexible flat cable.

FIG. 17 is a diagram illustrating one example of the allocation of signals to signal output terminals of a first flexible flat cable or a second flexible flat cable in a third embodiment.

DETAILED DESCRIPTION OF EXEMPLARY EMBODIMENTS

Appropriate embodiments of the present invention will be described in detail below using the diagrams. The diagrams which are used are for convenience of description. Here, the embodiments which are described below do not unreasonably limited the content of the present invention which is described in the scope of the claims. In addition, all of the configurations which are described below do not limit the essential constituent elements of the present invention.

1. First Embodiment

1-1. Liquid Discharge Apparatus Concept

A printing apparatus which is one example of a liquid discharge apparatus as in the present embodiment is an ink jet printer which forms groups of ink dots on a printing medium such as paper by ink being discharged in accordance with image data which is supplied from an external host computer, and due to this, forms images (which includes text, diagrams, and the like) according to the image data.

Here, it is possible for examples of the liquid discharge apparatus to include, for example, a printing apparatus such as a printer, a colorant material discharge apparatus which is used in manufacturing color filters such as for a liquid crystal display, an electrode material discharge apparatus which is used in forming electrodes for an organic EL display, a field emission display (FED), and the like, and a biological organic matter discharge apparatus which are used in bio-chip manufacture.

Figure 1:
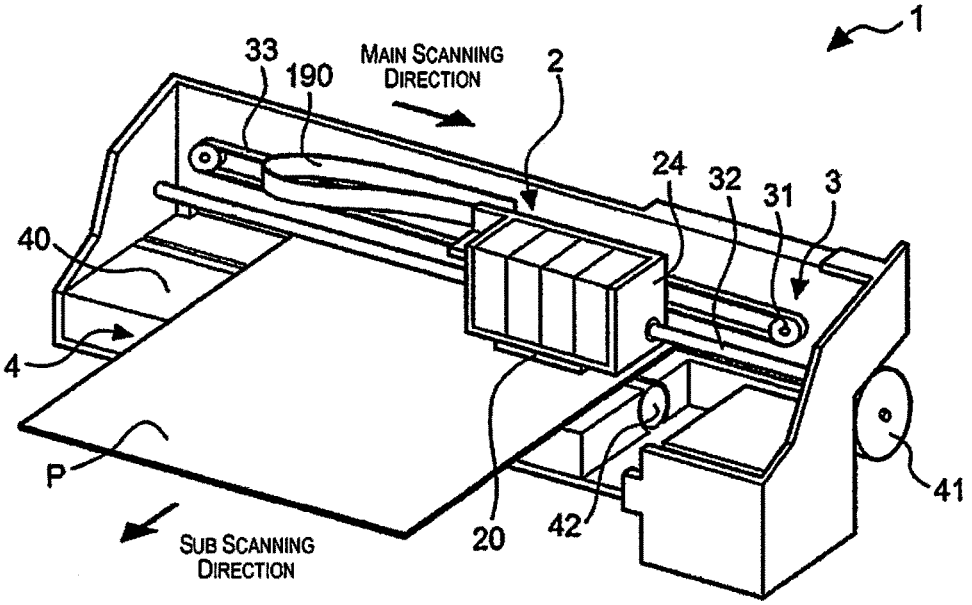
FIG. 1 is a diagram illustrating a schematic configuration of a liquid discharge apparatus.

FIG. 1 is a perspective diagram illustrating a schematic configuration of inner sections of a liquid discharge apparatus 1. As shown in FIG. 1, the liquid discharge apparatus 1 is provided with a movement mechanism 3 which moves a moving mechanism 2 (back and forth) in a main scanning direction.

The movement mechanism 3 has a carriage motor 31 which is the drive source for the moving body 2, a carriage guide shaft 32 where both ends are fixed, and a timing belt 33 which extends substantially parallel with the carriage guide shaft 32 and which is driven using the carriage motor 31.

A carriage 24 which is in the moving body 2 is supported by the carriage guide shaft 32 so as to be free to move back and forth and is fixed to one portion of the timing belt 33. For this reason, the moving body 2 slides and moves back and forth due to being guided by the carriage guide shaft 32 when the timing belt 33 is run forward and backward by the carriage motor 31.

In addition, a head unit 20 is provided within the moving body 2 at a portion which opposes a printing medium P. The head unit 20 is for discharging ink droplets (liquid droplets) from a plurality of nozzles as will be described later and is configured so that driving signals, various types of control signals, and the like are supplied via a plurality of flexible flat cables 190.

The liquid discharge apparatus 1 is provided with a transport mechanism 4 which transports the printing medium P on a platen 40 in a sub scanning direction. The transport mechanism 4 is provided with a transport motor 41 which is a drive source and a transport roller 42 which transports the printing medium P in the sub scanning direction by being rotated by the transport motor 41.

Images are formed on the surface of the printing medium P due to a liquid (ink droplets) being discharged while the head unit 20 which is provided in the moving body 2 slides at timings where the printing medium P is being transported by the transport mechanism 4.

1.2 Electrical Configuration of Liquid Discharge Apparatus

Figure 2:
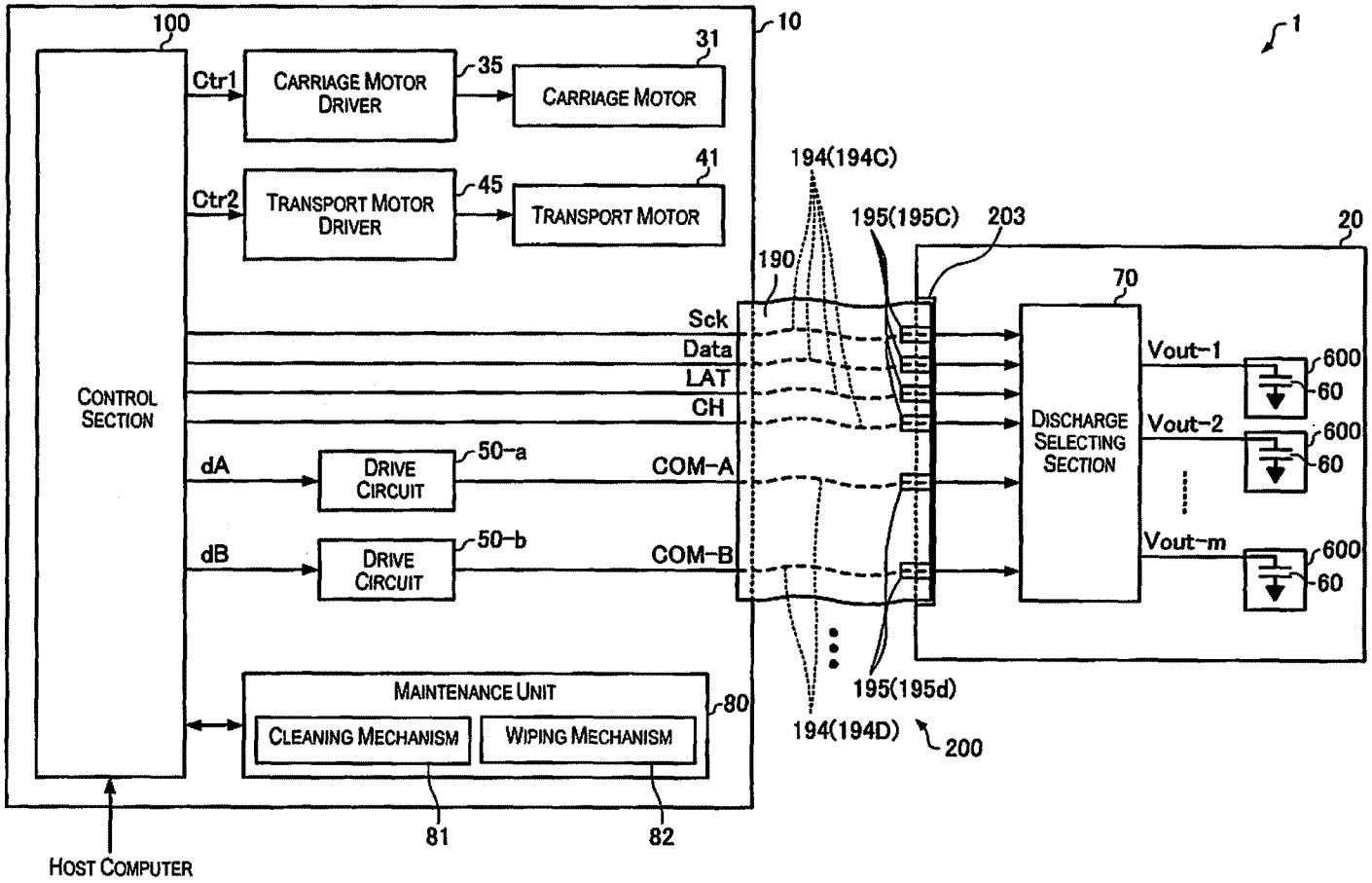
FIG. 2 is a block diagram illustrating an electrical configuration of a liquid discharge apparatus.

FIG. 2 is a block diagram illustrating an electrical configuration of the liquid discharge apparatus 1.

As shown in the diagram, a control unit 10 and the head unit 20 are connected in the liquid discharge apparatus 1 via a flexible flat cable grouping 200 which includes the plurality of flexible flat cables 190.

The control unit 10 has a control section 100, the carriage motor 31, a carriage motor driver 35, the transport motor 41, a transport motor driver 45, a drive circuit 50-*a*, a drive circuit 50-*b*, and a maintenance unit 80. Among these, the control section 100 outputs various types of control signals and the like for controlling each section when image data is supplied from a host computer.

In detail, the control section 100 supplies a control signal Ctr1 with regard to the carriage motor driver 35 and the carriage motor driver 35 drives the carriage motor 31 in accordance with the control signal Ctr1. Due to this, movement of the carriage 24 in the main scanning direction is controlled.

In addition, the control section 100 supplies a control signal Ctr2 with regard to the transport motor driver 45 and the transport motor driver 45 drives the transport motor 41 in accordance with the control signal Ctr2. Due to this, movement due to the transport mechanism 4 in the main scanning direction is controlled.

In addition, the control section 100 supplies digital data dA to the drive circuit 50-*a* and supplies digital data dB to the drive circuit 50-*b*. Here, out of the driving signals which are supplied to the head unit 20, the data dA regulates the waveform of a driving signal COM-A and the data dB regulates the waveform of a driving signal COM-B.

The drive circuit 50-*a* supplies the driving signal COM-A where class-D amplification is carried out to the head unit 20 after digital/analog conversion is carried out on the data dA. In the same manner, the drive circuit 50-*b* supplies the driving signal COM-B where class-D amplification is carried out to the head unit 20 after digital/analog conversion is carried out on the data dB. In this manner, the drive circuits 50-*a* and 50-*b* function as control signal generating sections which generate driving signals.

With regard to the drive circuits 50-*a* and 50-*b*, only the data which is input and the driving signal which is output are different and the circuit configuration which will be described later is the same. For this reason, in cases where it is not particularly necessary for the drive circuits 50-*a* and 50-*b* to be separately distinguished (for example, in the case of describing FIG. 7 which will be described later), the hyphen and the letter are omitted and the drive circuits 50-*a* and 50-*b* are described simply with the reference numeral "50".

In addition, the control section 100 generates a data signal Data, a clock signal Sck, and control signals LAT and CH as control signals which control the head unit 20 and supply these signals to the head unit 20 so that an image is formed on the surface of the printing medium P according to the image data which is supplied from a host computer. In this manner, the control section 100 functions as a control signal generating section which generates control signals which control the head unit 20.

At least of the flexible flat cables 190 includes a plurality of signal lines 194 which include a driving signal line 194D which transfers driving signals (the driving signals COM-A and COM-B) and a control signal line 194C which transfers control signals (the clock signal Sck, the data signal Data, the control signals LAT and CH, and the like). In addition, at least one of the flexible flat cables 190 includes a plurality of signal output terminals 195 which include a driving signal output terminal 195D which outputs driving signals (the driving signals COM-A and COM-B) to the head unit 20 and a control signal output terminal 195C which outputs control signals (the clock signal Sck, the data signal Data, the control signals LAT and CH, and the like) to the head unit 20.

In addition, the control section 100 may execute a maintenance process using the maintenance unit 80 in order for the normal ink discharge state to be restored in discharge sections 600. The maintenance unit 80 may have a cleaning mechanism 81 for performing a cleaning process (pumping process) where viscous ink inside the discharge sections 600, bubbles, and the like are suctioned out using a tube pump (which is omitted from the diagrams) as a maintenance process. In addition, the maintenance unit 80 may have a wiping mechanism 82 for performing a wiping process where foreign bodies such as paper dust which becomes attached to the vicinity of the nozzles in the discharge sections 600 are wiped away using a wiper (which is omitted from the diagrams) as a maintenance process.

The head unit 20 has a discharge selecting section 70 and a discharge group which is formed from a plurality of the discharge sections 600 (m number of the discharge sections 600). Here, the head unit 20 may be provided in the drive circuit 50-*a* and the drive circuit 50-*b*. A plurality of connection sections 203, which are respectively connected to the plurality of flexible flat cables 190, are provided in the head unit 20, and various types of signals which are output from the plurality of signal output terminals 195 are supplied to the discharge selecting section 70 and the like by being transferred by a plurality of signal lines 194 in a state where the flexible flat cables 190 are respectively connected to the connection sections 203.

The clock signal Sck, the data signal Data, and the control signals LAT and CH which are sent from the control section 100 are input into the discharge selecting section 70. In the present embodiment, the data signal Data includes printing data SI and program data SP. The printing data SI is data which regulates the size (gradient) of the dots which are formed on the printing medium P using the respective discharge operations of the m number of the discharge sections 600. As will be described later, the size of the dots is regulated to 4 gradients of "large dot", "medium dot", "small dot", and "no recording (no dot)" in the present embodiment. In addition, the program data SP is data for selecting driving pulses (waveforms) which are applied to the piezoelectric elements 60 of the discharge sections 600 from the driving signals COM-A and COM-B.

The discharge selecting section 70 is provided with a SP shift register which holds the program data SP and a SI shift register which holds the printing data SI. Then, the discharge selecting section 70 forwards and holds the printing data SI and the program data SP which are included in the data signal Data in series one bit at a time using the SI shift register and the SP shift register at timings on the edge of the clock signal Sck.

In addition, the discharge selecting section 70 selects waveforms which are included in the driving signals COM-A and COM-B based on the printing data SI and the program data SP which are forwarded and held by the SI shift register and the SP shift register as well as the control signals LAT and CH and applies m number of the driving signals Vout (Vout-1 to Vout-m) which are included in the waveforms which are selected respectively to the m number of the discharge sections 600. In this manner, the discharge selecting section 70 receives the control signals (the clock signal Sck, the data signal Data, and the control signals LAT and CH), selects the discharge sections 600 which are to discharge the liquid, and switches between whether or not the driving signals COM-A and COM-B are to applied.

The m number of the discharge sections 600 are able to discharge liquid droplets in a plurality of sizes due to the driving signals Vout (Vout-1 to Vout-m) being applied. In detail, the discharge selecting section 70 applies the m number of the driving signals Vout (Vout-1 to Vout-m) which are equivalent to any of the four gradients ("large dot", "medium dot", "small dot", and "no recording") with regard to the m number of the discharge sections 600 so that an image is formed on the surface of the printing medium P according to the image data.

1-3. Configuration of Discharge Sections

Figure 3:
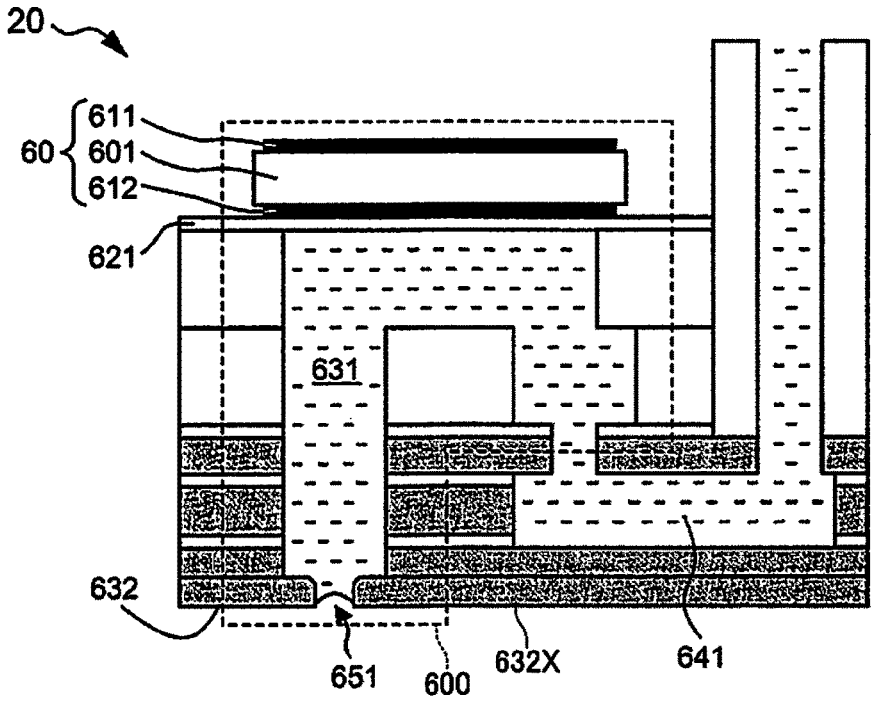
FIG. 3 is a diagram illustrating a configuration of a discharge section of a head unit.

The configuration of the discharge sections 600 for discharging ink by the drive signals Vout being applied to the piezoelectric elements 60 will be described next in a simple manner. FIG. 3 is a diagram illustrating a schematic configuration which corresponds to one of the discharge sections 600 of the head unit 20.

As shown in FIG. 3, the discharge section 600 of the head unit 20 includes the piezoelectric element 60, a vibrating plate 621, a cavity (pressure chamber) 631, and a nozzle 651. Among these, the vibrating plate 621 functions as a diaphragm which is displaced (bent and vibrated) by the piezoelectric element 60 which is provided on the upper surface in the diagram and which expands or contracts the inner capacity of the cavity 631 which is filled with ink. The nozzle 651 is an hole section which is provided in a nozzle plate 632 and which communicates with the cavity 631. An inner section of the cavity 631 is filled with liquid (for example, ink) and the inner capacity of the cavity 631 changes due to the displacement of the piezoelectric element 60. The nozzle 651 communicates with the cavity 631 and the liquid inside the cavity 31 is discharged as liquid droplets according to changes in the inner capacity of the cavity 631.

The piezoelectric element 60 which is shown in FIG. 3 is a structure where a piezoelectric body 601 is interposed by a pair of electrodes 611 and 612. A middle portion of the piezoelectric body 601 with this structure bends with regard to both end sections in the up and down direction in FIG. 3 along with the electrodes 611 and 612 and the vibrating plate 621 according to the voltage which is applied by the electrodes 611 and 612. In detail, the piezoelectric element 60 is configured so as to bend in an upward direction when the voltage of the driving signal Vout is high and to bend in a downward direction when the voltage of the driving signal Vout is low. With this configuration, due to the inner capacity of the cavity 631 expanding when the piezoelectric element 60 bends in an upward direction, ink is drawn in from a reservoir 641, and due to the inner capacity of the cavity 631 contracting when the piezoelectric element 60 bends in a downward direction, ink is discharged from the nozzle 651 to the extent of the contraction.

Here, the piezoelectric element 60 is not limited to the structure which is shown and it is sufficient if the piezoelectric element 60 is a type where it is possible for liquid such as ink to be discharged due to the piezoelectric element 60 changing shape. In addition, the piezoelectric element 60 is not limited to bending and vibrating and may be configured using so-called vertical vibration.

1.4 Configuration of Driving Signals for Discharge Sections

Figure 4A:
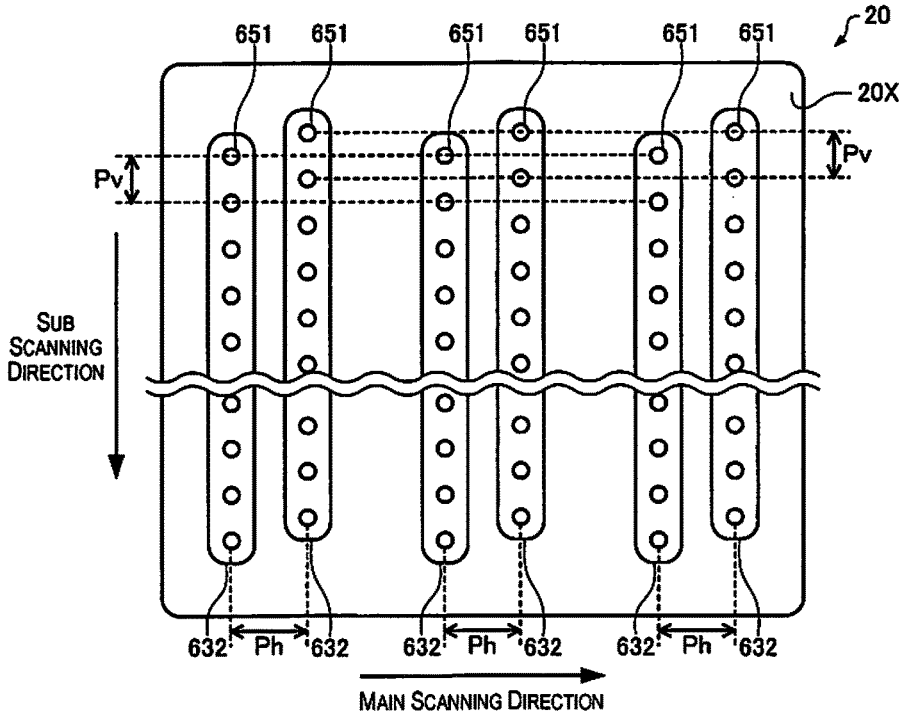
FIG. 4A is a diagram illustrating a nozzle alignment of a head unit.

FIG. 4A is a diagram illustrating one example of an alignment of the nozzles 651. As shown in FIG. 4A, the nozzles 651 are aligned into, for example, six row as follows. In detail, when only looking at one row, there is a relationship in that the nozzles 651 which are a plurality in number are arranged with a pitch Pv along the sub scanning direction and each group of two rows (the two rows on the right end, the two rows in the middle, and the two rows on the left end) are separated by a pitch Ph in the main scanning direction and are shifted by half of the pitch Pv in the sub scanning direction.

Here, in a case of color printing, the pattern of the nozzles 651 is provided, for example, along the main scanning direction to correspond to each color such as C (cyan), M (magenta), Y (yellow), and K (black), but the case where the gradients are expressed with a single color will be described for simplification of the following description.

Figure 4B:
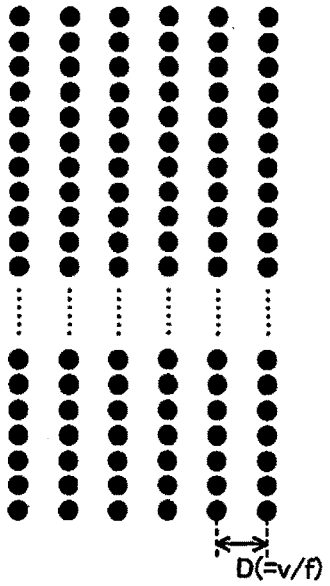
FIG. 4B is a diagram for explaining the basic resolution of image formation using the nozzle alignment shown in FIG. 4A.

FIG. 4B is a diagram for explaining the basic resolution of image formation using the nozzle alignment shown in FIG. 4A. Here, in order to simplify the description, the diagram is an example of a method (a first method) for forming one dot by ink droplets being discharged once from the nozzles 651 and shows dots where circular black marks are formed by ink droplets landing When the head unit 20 is moved with a velocity v in the main scanning direction, the velocity v and an interval D (in the main scanning direction) between the dots, which are formed by ink droplets landing from the nozzles 651 in the two rows (the two rows on the right end, the two rows in the middle, and the two rows on the left end as shown in FIG. 4A) which form a group as shown in FIG. 4B, have the following relationship.

That is, in a case where one dot is formed by ink droplets being discharged once, the dot interval D is expressed as a value (=v/f) where the velocity v is divided by ink discharge frequency f, in other words, as the distance by which the head unit 20 is moved with a cycle (1/f) over which ink droplets are repeatedly discharged.

Here, in the example in FIG. 4A and FIG. 4B, ink droplets which are discharged from two rows of the nozzles 651 land so as to match up in the same rows on the printing medium P with the relationship where the pitch Ph is proportional with regard to the dot interval D with a coefficient n. For this reason, the dot interval in the sub scanning direction is half of the dot interval in the main scanning direction as shown in FIG. 4B. It is obvious that the alignment of the dots is not limited to the example in the diagrams.

Here, it is sufficient if the velocity v by which the head unit 20 moves in the main scanning direction is simply high in order for high-speed printing to be realized. However, if the velocity v is just high, the dot interval D becomes longer. For this reason, in order to realize high-speed printing on top of securing a certain degree of resolution, it is necessary for the number of dots which are formed in each unit of time to be increased by increasing the ink discharge frequency f.

In addition, it is sufficient to increase the number of dots which are formed in each unit of time in order to increase the resolution independently of printing speed. However, in cases where the number of dots is increased, adjacent dots do not join up if the ink is not set to a small amount and the printing speed is reduced if the ink discharge frequency f is not high.

In this manner, it is necessary to increase the ink discharge frequency fin order to realize high-speed printing and high-resolution printing.

On the other hand, as a method for forming dots on the printing medium P, as well as the method for forming one dot by ink droplets being discharged once, there is a method (a second method) for forming one dot where two or more of the ink droplets are able to be discharged in a unit of time so that one or more of the ink droplets which are discharge in a unit of time lands and the one or more of the ink droplets which land join up, and a method (a third method) for forming two or more dots without the two or more of the ink droplets joining up.

In the present embodiment, the four gradients of "large dot", "medium dot", "small dot", and "no recording (no dot)" are expressed using the second method by ink for one dot being discharged twice at most. In order for the four gradients to be expressed, there is a first pattern and a second pattern over one cycle for each by two types of driving signals COM-A and COM-B being prepared in the present embodiment. There is a configuration where the driving signals COM-A and COM-B for the first pattern and the second pattern are supplied to the piezoelectric element 60 over one cycle by being selected (or not selected) according to the gradient which is to be expressed.

Figure 5:
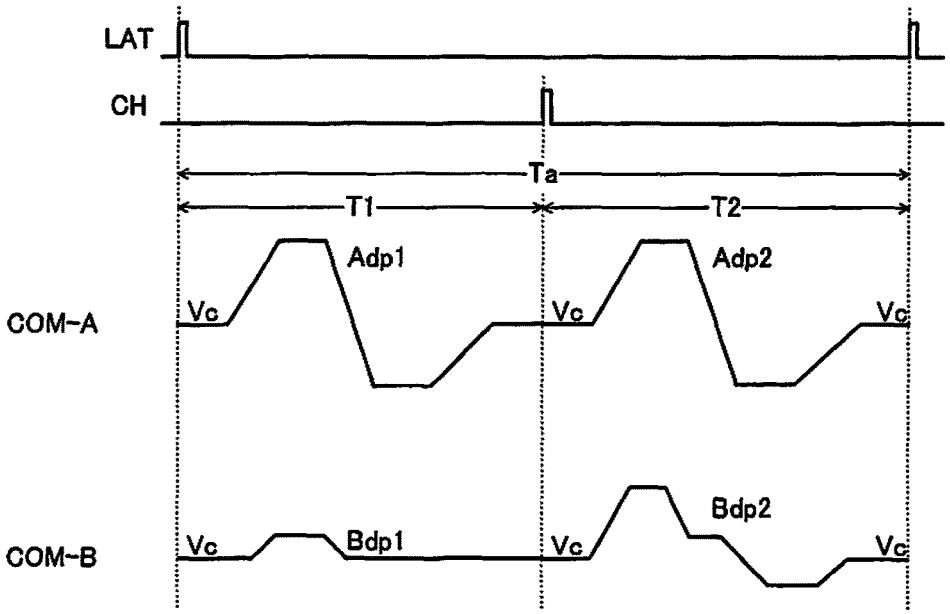
FIG. 5 is a diagram illustrating waveforms for driving signals COM-A and COM-B.

FIG. 5 is a diagram illustrating waveforms for the driving signals COM-A and COM-B. As shown in FIG. 5, the driving signal COM-A is a waveform where a trapezoidal waveform Adp1, which is arranged over a time period T1 from when the control signal LAT rises up to when the control signal CH rises up, and a trapezoidal waveform Adp2, which is arranged over a time period T2 from when the control signal CH rises up to when the control signal LAT rises up, are continuous. New dots are formed on the printing medium P over each cycle Ta with the time period which is formed on the time period T1 and the time period T2 as the cycle Ta for printing.

In the present embodiment, the trapezoidal waveforms Adp1 and Adp2 are waveforms which are substantially the same as each other and are waveforms where, if the trapezoidal waveforms Adp1 and Adp2 were to be supplied to one end of the piezoelectric elements 60, a specific amount, in more detail, a moderate amount, of ink would be discharged from the nozzles 651 which correspond to the piezoelectric elements 60.

The driving signal COM-B is a waveform where a trapezoidal waveform Bdp1 which is arranged over the time period T1 and a trapezoidal waveform Adp2 which is arranged over the time period T2 are continuous. In the present embodiment, the trapezoidal waveforms Bdp1 and Bdp2 are waveforms which are different to each other. Out of the trapezoidal waveforms, the trapezoidal waveform Bdp1 is a waveform for preventing increases in the viscosity of the ink by slightly vibrating the ink in the vicinity of the open section of the nozzles 651. For this reason, if the trapezoidal waveform Bdp1 were to be supplied to one end of the piezoelectric elements 60, ink droplets would not be discharged from the nozzles 651 corresponding to the piezoelectric elements 60. In addition, the trapezoidal waveform Bdp2 is a waveform which is different to the trapezoidal waveform Adp1 (Adp2). The trapezoidal waveform Bdp2 is a waveform where, if the trapezoidal waveform Bdp2 were to be supplied to one end of the piezoelectric elements 60, an amount of ink which is less than the specific amount described above would be discharged from the nozzles 651 corresponding to the piezoelectric elements 60.

Here, the voltage at the timings for the start of the trapezoidal waveforms Adp1, Adp2, Bdp1, and Bdp2 and the voltage at the timings of the end of the trapezoidal waveforms Adp1, Adp2, Bdp1, and Bdp2 are both the same voltage which is a voltage Vc. That is, the trapezoidal waveforms Adp1, Adp2, Bdp1, and Bdp2 are waveforms which each start with the voltage Vc and end with the voltage Vc.

The discharge selecting section 70 applies the driving signals Vout (Vout-1 to Vout-m) which correspond to one out of "large dot", "medium dot", "small dot", and "no recording" respectively with regard to them number of the discharge sections 600 by combining any of the waveforms at time periods T1 and any of the waveforms at time periods T2 for the driving signals COM-A and COM-B based on the data signal Data (the printing data SI and the program data SP) which is forwarded and held in the SI shift register and the SP shift register and the control signals LAT and CH.

Figure 6:
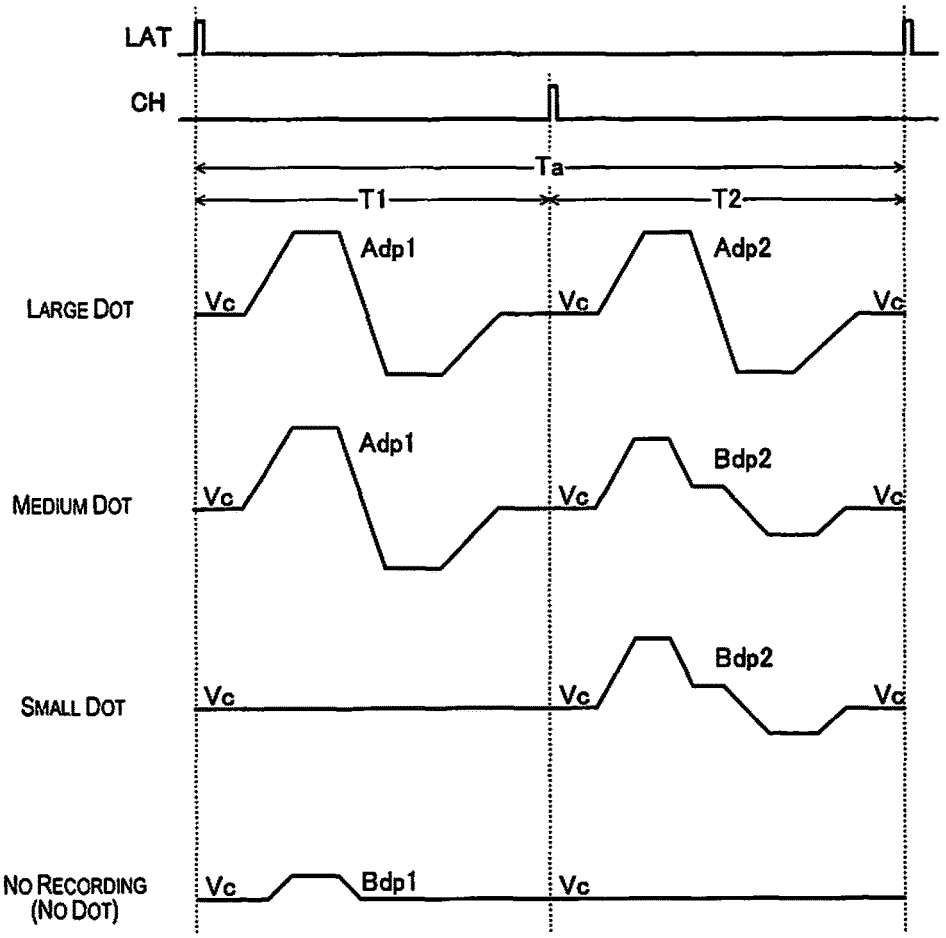
FIG. 6 is a diagram illustrating waveforms for driving signals Vout.

FIG. 6 is a diagram illustrating waveforms for the driving signals Vout which respectively correspond to "large dot", "medium dot", "small dot", and "no recording".

As shown in FIG. 6, the driving signal Vout which corresponds to "large dot" is a waveform where the trapezoidal waveform Adp1 of the driving signal COM-A at the time period T1 and the trapezoidal waveform Adp2 of the driving signal COM-A at the time period T2 are continuous. When the driving signal Vout is supplied to one end of the piezoelectric elements 60, a moderate amount of ink is discharged twice from the nozzles 651 which correspond to the piezoelectric elements 60 over the cycle Ta. For this reason, a large dot is formed on the printing medium P due to the ink landing and combining.

The driving signal Vout which corresponds to "medium dot" is a waveform where the trapezoidal waveform Adp1 of the driving signal COM-A at the time period T1 and the trapezoidal waveform Bdp2 of the driving signal COM-B at the time period T2 are continuous. When the driving signal Vout is supplied to one end of the piezoelectric elements 60, a moderate amount of ink and a small amount of ink is discharged twice from the nozzles 651 which correspond to the piezoelectric elements 60 over the cycle Ta. For this reason, a medium dot is formed on the printing medium P due to the ink landing and combining.

The driving signal Vout which corresponds to "small dot" is the voltage Vc immediately before being held using the capacity of the piezoelectric element 60 at the time period T1 and is the trapezoidal waveform Bdp2 of the driving signal COM-B at the time period T2. When the driving signal Vout is supplied to one end of the piezoelectric elements 60, only a small amount of ink is discharged at the time period T2 from the nozzles 651 which correspond to the piezoelectric elements 60 over the cycle Ta. For this reason, a small dot is formed on the printing medium P due to the ink landing and combining.

The driving signal Vout which corresponds to "no recording" is the trapezoidal waveform Bdp1 of the driving signal COM-B at the time period T1 and is the voltage Vc immediately before being held using the capacity of the piezoelectric element 60 at the time period T2. When the driving signal Vout is supplied to one end of the piezoelectric elements 60, the nozzles 651 which correspond to the piezoelectric elements 60 only vibrate slightly at the time period T2 and ink is not discharged over the cycle Ta. For this reason, no ink lands and no dots are formed on the printing medium P.

In the present embodiment, the printing data SI is data of a total of 2m bits which includes two bits of printing data (SIH and SIL) with regard to each of the m number of discharge sections 600. In more detail, the printing data SI is configured using two bits of printing data with regard to the first of the discharge sections 600 (SIH-1 and SIL-1), two bits of printing data with regard to the second of the discharge sections 600 (SIH-2 and SIL-2), . . . , and two bits of printing data with regard to the mth of the discharge sections 600 (SIH-m and SIL-m) in order from the front.

In addition, in the present embodiment, the program data SP is a total of 16 bits of data which includes four bits of data for regulating the selection or non-selection of the waveforms of the driving signals COM-A and COM-B for the time period T1 and the selection or non-selection of the waveforms of the driving signals COM-A and COM-B for the time period T2 with regard to each of the four types of large dot, medium dot, small dot, and no recording.

Then, the discharge selecting section 70 holds the 2m bits of the printing data SI at the 2m-bit SI shift register and holds the 16 bits of the program data SP at the 16-bit SP shift register by shifting the data signal Data by one bit at a time at the timing of the edge of the clock signal Sck.

In addition, the discharge selecting section 70 takes in and holds the 2m bits of the printing data SI, which is held at the 2m-bit SI shift register, using a 2m-bit SI latch at the timing of the edge of the control signal LAT. In the same manner, the discharge selecting section 70 takes in and holds the 16 bits of the program data SP, which is held at the 16-bit SP shift register, using a 16-bit SP latch at the timing of the edge of the control signal LAT. Then, the discharge selecting section 70 generates the m number of the driving signals Vout-1 to Vout-m based on the printing data SI which is held at the SI latch and the program data SP which is held at the SP latch.

1.5 Configuration of Drive Circuits

Next, the drive circuits 50-*a* and 50-*b* will be described. The driving signal COM-A is generated in the following manner when summarizing using the drive circuit 50-*a* which is one out of the drive circuits 50-*a* and 50-*b*. That is, first, the drive circuit 50-*a* converts the data dA which is supplied from the control section 100 into analog, second, feeds back the driving signal COM-A which is output, feeds back the output driving signal COM-A, corrects deviation between the signal which is based on the driving signal COM-A (the attenuated signal) and the target signal using the high-frequency component of the driving signal COM-A, and generates a modulation signal in accordance with the signal which is corrected, third, generates an amplified modulation signal by switching a transistor in accordance with the modulation signal, and fourth, smooths (demodulates) the amplified modulation signal using a low path filter and outputs the signal which is smoothed as the driving signal COM-A.

The drive circuit 50-*b* which is other one out of the drive circuits 50-*a* and 50-*b* is configured in the same manner and only differs with regard to the point in that the driving signal COM-B is output from the data dB. Therefore, in FIG. 7, the drive circuits 50-*a* and 50-*b* are described as the drive circuits 50 without being distinguished as the drive circuits 50-*a* and 50-*b*.

Here, the data which is input and the driving signals which are output uses the notation of dA (dB) and COM-A (COM-B) and are expressed such that the data dA is input and the driving signal COM-A is output in the case of the drive circuit 50-*a* and the data dB is input and the driving signal COM-B is output in the case of the drive circuit 50-*b*.

Figure 7:
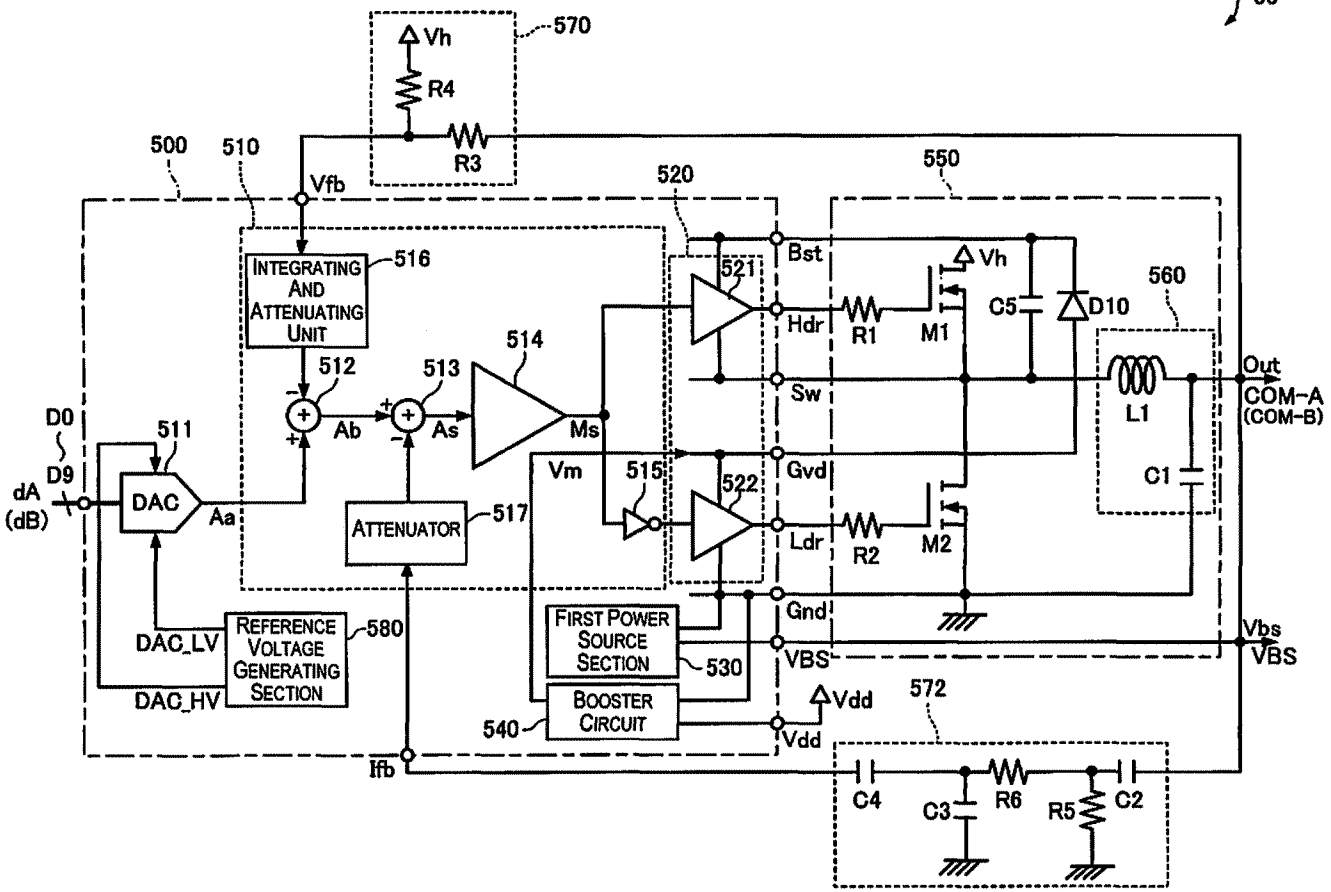
FIG. 7 is a diagram illustrating a circuit configuration of a driving circuit.

FIG. 7 is a diagram illustrating the circuit configuration of the driving circuit 50.

Here, a configuration for outputting the driving signal COM-A is shown in FIG. 7 and the circuit for generating both the driving circuits COM-A and COM-B for the two systems is packaged into one unit in an integrated circuit apparatus 500 in practice.

As shown in FIG. 7, the drive circuit 50 is configured from the integrated circuit apparatus 500 and an output circuit 550 as well as various types of elements such as a resistor and a capacitor.

The driving circuit 50 in the present embodiment is provided with a modulation section 510 which generates a modulation signal where the pulse of the original signal is modulated, a gate driver 520 which generates an amplified control signal based on the modulation signal, transistors (a first transistor M1 and a second transistor M2) which generate an amplified modulation signal where the modulation signal is amplified based on the amplified modulation signal, a low pass filter 560 which generates a driving signal by demodulating the amplified modulation signal, feedback circuits (a first feedback circuit 570 and a second feedback circuit 572) which feeds back the driving signal to the modulation section 510, and a booster circuit 540. In addition, the drive circuit 50 may be provided with a first power source section 530 where a signal is applied to a terminal which is different to the terminal to which the driving signal of the piezoelectric element 60 is applied.

The integrated circuit apparatus 500 in the present embodiment is provided with the modulation section 510 and the gate driver 520.

The integrated circuit apparatus 500 outputs gate signals (amplified control signals) to the first transistor M1 and the second transistor M2 based on 10 bits of the data dA (the original signal) which is input from the control section 100 via terminals D0 to D9. For this reason, the integrated circuit apparatus 500 includes a digital to analog converter (DAC) 511, an accumulator 512, an accumulator 513, a comparator 514, an integrating and attenuating unit 516, an attenuator 517, an inverter 515, a first gate driver 521, a second gate driver 522, the first power source section 530, the booster circuit 540, and a reference voltage generating section 580.

The reference voltage generating section 580 generates a first reference voltage DAC_HV (a high-voltage reference voltage) and a second reference voltage DAC_LV (a low-voltage reference voltage) which are modulated based on an adjustment signal and supplies the reference voltages to the DAC 511.

The DAC 511 converts the data dA which regulates the waveform of the driving signal COM-A to an original driving signal Aa with a voltage which is between the first reference voltage DAC-HV and the second reference voltage DAC-LV and supplies the original driving signal Aa to the input terminal (+) of the accumulator 512. Here, the maximum value and the minimum value for the amplitude of the voltage of the original driving signal Aa (for example, approximately 1-2 V) is determined by the first reference voltage DAC-HV and the second reference voltage DAC- LV, and the driving signal where the voltage is amplified is the driving signal COM-A. That is, the original driving signal Aa is a signal with a target of being the driving signal COM-A before amplification.

The integrating and attenuating unit 516 attenuates and integrates the voltage at a terminal Out which is input via a terminal Vfb, that is, the driving signal COM-A and supplies the driving signal COM-A to the input terminal (−) of the accumulator 512.

The accumulator 512 supplies a signal Ab with a voltage which is integrated by the voltage at the input terminal (−) being subtracted from the voltage at the input terminal (+) to the input terminal (+) of the accumulator 513.

Here, the power source voltage for the circuits from the DAC 511 to the inverter 515 is 3.3 V with a low amplitude (a voltage Vdd which is supplied from a power source terminal Vdd). For this reason, since there are cases where the voltage of the driving signal COM-A exceeds 40V when at the maximum while the voltage of the original driving signal Aa is approximately 2 V when at the maximum, the voltage of the driving signal COM-A is attenuated using the integrating and attenuating unit 516 so that the amplitude range of both voltages matches at the time of determining the deviation.

The attenuator 517 attenuates the high-frequency component of the driving signal COM-A which is input via a terminal Ifb and supplies the driving signal COM-A to the input terminal (−) of the accumulator 513. The accumulator 513 supplies a signal As with a voltage where the voltage at the input terminal (−) is subtracted from the voltage at the input terminal (+) to the comparator 514. In the same manner as with the integrating and attenuating unit 516, the attenuation due to the attenuator 517 is carried out in order to match the amplitudes at the time of feedback of the driving signal COM-A.

The voltage of the signal As which is output from the accumulator 513 is a voltage where the attenuated voltage of the signal which is supplied to the terminal Ifb is subtracted by the attenuated voltage of the signal which is supplied from the terminal Vfb being subtracted from the voltage of the original driving signal Aa. For this reason, it is possible for the voltage of the signal As due to the accumulator 513 to be a signal where the deviation, where the attenuated voltage of the driving signal COM-A which is output from the terminal Out is subtracted from the voltage of the original driving signal Aa which is the target, is corrected using the high-frequency components of the driving signal COM-A.

The comparator 514 outputs a modulation signal Ms where the pulse is modulated in the following manner based on the subtraction voltage due to the accumulator 513. In detail, the comparator 514 outputs the modulation signal Ms which is a H level when the signal As which is output from the accumulator 513 is equal to or more than a voltage threshold Vth1 when the voltage is rising and which is a L level when the signal As which is output from the accumulator 513 is equal to or less than a voltage threshold Vth2 when the voltage is falling. Here, as will be described later, the voltage thresholds are set with a relationship where Vth1>Vth2.

The modulation signal Ms due to the comparator 514 is supplied to the second gate driver 522 through a logic inversion using the inverter 515. On the other hand, the modulation signal Ms is supplied without undergoing a logic inversion in the first gate driver 521. For this reason, the logic levels which are supplied to the first gate driver 521 and the second gate driver 522 have a relationship of being exclusive to each other.

The logic levels which are supplied to the first gate driver 521 and the second gate driver 522 may be timing controls so as to not both be at H levels at the same time in practice (so that the first transistor M1 and the second transistor M2 are not on at the same time). For this reason, exclusive has the meaning in a strict sense of not being at H levels at the same time (so that the first transistor M1 and the second transistor M2 are not on at the same time).

However, the modulation signal which is referred to here is the modulation signal Ms in a strict sense, but a negation signal for the modulation signal Ms is included as the modulation signal Ms when considering pulse modulation according to the original driving signal Aa. That is, not only is the modulation signal Ms included in the modulation signal where the pulse is modulated according to the original driving signal Aa but modulation signals where the logic level of the modulation signal Ms is inverted or modulation signals where the timing is controlled are also included.

Here, since the comparator 514 outputs the modulation signal Ms, the circuits up until the comparator 514 or the inverter 515, that is, the accumulator 512, the accumulator 513, the comparator 514, the inverter 515, the integrating and attenuating unit 516, and the attenuator 517 are equivalent to the modulation section 510 which generates the modulation signal.

The first gate driver 521 is output from a terminal Hdr by level shifting the low amplitude logic which is the output signal from the comparator 514 to a high amplitude logic. Out of the power source voltages from the first gate driver 521, the high side is a voltage which is applied via a terminal Bst and the low side is a voltage which is applied via a terminal Sw. The terminal Bst is connected to an end of a capacitor C5 and the cathode terminal of a diode D10 for preventing reverse flow. The terminal Sw is connected to the source electrode of the first transistor M1, the drain electrode of the second transistor M2, the other end of the capacitor C5, and an end of an inductor L1. The anode electrode of the diode D10 is connected to a terminal Gvd and a voltage Vm (for example, 7.5 V), which is output from the booster circuit 540, is applied. Accordingly, the potential difference between the terminal Bst and the terminal Sw is approximately equal to the potential difference between both ends of the capacitor C5, that is, the voltage Vm (for example, 7.5 V).

The second gate driver 522 operates on a lower potential side than the first gate driver 521. The second gate driver 522 outputs from a terminal Ldr by level shifting the low amplitude logic (for example, L level: O V, H level: 3.3 V) which is the output signal from the inverter 515 to a high amplitude logic (for example, L level: O V, H level: 7.5 V). Out of the power source voltages from the second gate driver 522, the voltage Vm (for example, 7.5 V) is applied as the high side and a voltage of zero is applied via a ground terminal Gnd as the low side, that is, the ground terminal Gnd is connected to the ground. In addition, the terminal Gvd is connected to the anode electrode of the diode D10.

The first transistor M1 and the second transistor M2 are, for example, N channel type field effect transistors (FET). Out of the transistors, in the first transistor M1 which is the high side, a voltage Vh (for example, 42 V) is applied to the drain electrode and the gate electrode is connected to the terminal Hdr via a resistor R1. In the second transistor M2 which is the low side, the gate electrode is connected to the terminal Ldr via a resistor R2 and the source electrode is connected to the ground.

Accordingly, when the first transistor M1 is off and the second transistor M2 is on, the voltage at the terminal Sw is 0 V and the voltage Vm (for example, 7.5 V is applied to the terminal Bst. On the other hand, when the first transistor M1 is on and the second transistor M2 is off, the voltage Vh (for example, 42 V) is applied to the terminal Sw, and Vh+Vm (for example, 49.5 V) is applied to the terminal Bst.

That is, since the reference potential (the potential at the terminal Sw) changes to 0 V or Vh (for example, 42 V) according to the operation of the first transistor M1 and the second transistor M2 by the floating power source of the capacitor C5, the first gate driver 521 outputs an amplified control signal where the L level is 0 V and the H level is Vm (for example, 7.5 V) or the L level is Vh (for example, 42 V) and the H level is Vh+Vm (for example, 49.5 V). In contrast to this, since the reference potential (the potential at the terminal Gnd) is fixed at 0 V without any relation to the operations of the first transistor M1 and the second transistor M2, the second gate driver 522 outputs an amplified control signal where the L level is 0 V and the H level is Vm (for example, 7.5 V).

The other end of the inverter L1 is the terminal Out which is the output using the driving circuit 50 and supplies the driving signal COM-A from the terminal Out to the head unit 20 via the flexible flat cable 190 (refer to FIG. 1 and FIG. 2).

The terminal Out is connected to one end of the capacitor C1, one end of the capacitor C2, and one end of a resistor R3. Out of these, the other end of the capacitor C1 is connected to the ground. For this reason, the inverter L1 and the capacitor C1 function as a low pass filter which smooths the amplified modulation signal which arrives at the connection point between the first transistor M1 and second transistor M2.

The other end of the resistor R3 is connected to the terminal Vfb and one end of a resistor R4 and the voltage Vh is applied to the other end of the resistor R4. Due to this, the driving signal COM-A which is from the terminal Out and passes through the first feedback circuit 570 (a circuit which is configured by the resistor R3 and the resistor R4) is pulled up and fed back in the terminal Vfb.

On the other hand, the other end of the capacitor C2 is connected to one end of a resistor R5 and one end of a resistor R6. Out of these, the other end of the resistor R5 is connected to the ground. For this reason, the capacitor C2 and the resistor R5 function as a high pass filter which permits passing through of high-frequency components, which are equal to or higher than a cutoff frequency, of the driving signal COM-A from the terminal Out. Here, the cutoff frequency of the high pass filter is set to, for example, approximately 9 MHz.

In addition, the other end of the resistor R6 is connected to one end of a capacitor C4 and one end of a capacitor C3. Out of these, the other end of the capacitor C3 is connected to the ground. For this reason, the resistor R6 and the capacitor C3 function as a low pass filter which permits passing through of low-frequency components, which are equal to or less than a cutoff frequency, of the signal components which pass through the high pass filter. Here, the cutoff frequency of the low pass filter is set to, for example, approximately 160 MHz.

Since the cutoff frequency of the high pass filter is set to be lower than the cutoff frequency of the low pass filter, the high pass filter and the low pass filter function as a band pass filter which permits passing through of high-frequency components of the driving signal COM-A within a specific frequency band.

The other end of the capacitor C4 is connected to the terminal Ifb of the integrated circuit apparatus 500. Due to this, the direct current component in the high-frequency components of the driving signal COM-A which passes through the second feedback circuit 572 (a circuit which is configured by the capacitor C2, the resistor R5, the resistor R6, the capacitor C3, and the capacitor C4) which functions as a band pass filter, is cut off and fed back in the terminal Ifb.

Here, the driving signal COM-A which is output from the terminal Out is a signal where the amplified modulation signal at the connection point (the terminal Sw) of the first transistor M1 and the second transistor M2 is smoothed using the low pass filter which is formed from the inverter L1 and the capacitor C1. Since the driving signal COM-A is fed back to the accumulator 512 after integration and subtraction via the terminal Vfb, there is self-excited oscillation at a frequency which is determined by the delay in feedback (the sum of delays due to smoothing by the inverter L1 and the capacitor C1 and delays due to the integrating and attenuating unit 516) and the feedback transfer function.

However, there are cases where it is not possible to increase the frequency of self-excited oscillation enough so that it is possible to secure sufficient accuracy of the driving signal COM-A with only feeding back via the terminal Vfb since the amount of delay in the feedback path via the terminal Vfb is large.

Therefore, in the present embodiment, the delays over the whole of the circuitry is reduced by providing a path where the high-frequency components of the driving signal COM-A is fed back via the terminal Ifb which is separate to the path via the terminal Vfb. For this reason, the frequency of the signal As where the high-frequency component of the driving signal COM-A is added to the signal Ab is increased so that it is possible to secure sufficient accuracy of the driving signal COM-A in comparison to a case where a path via the terminal Ifb is not provided.

Figure 8:
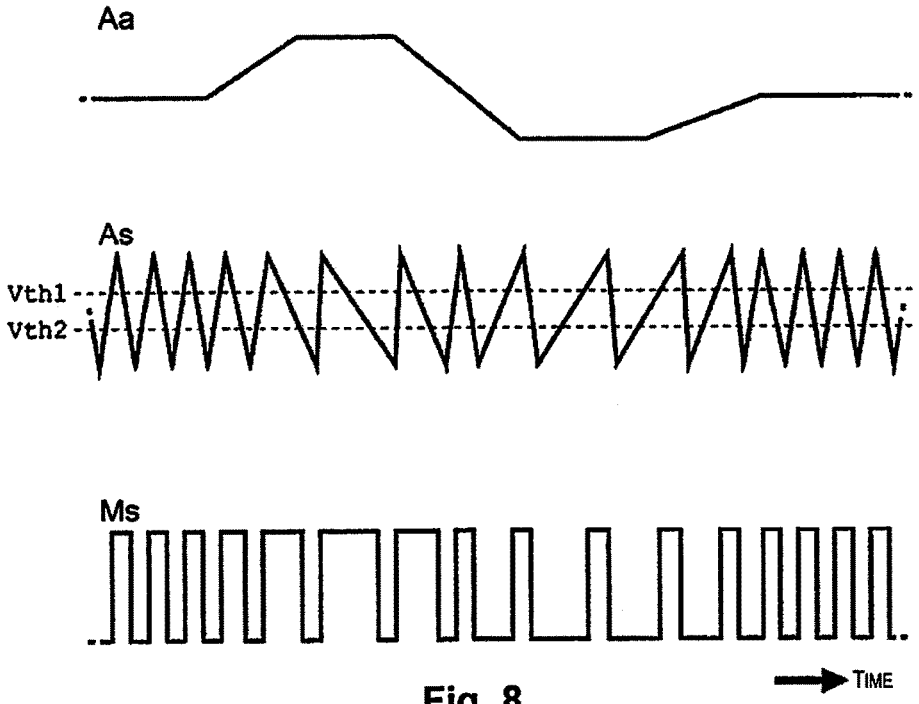
FIG. 8 is a diagram for explaining the operations of a driving circuit.

FIG. 8 is a diagram illustrating the relationship between the waveforms for the signal As and the modulation signal Ms and the waveform of the original driving circuit Aa.

As shown in the diagram, the signal As is a triangular wave and the oscillation frequency varies according to the voltage (the input voltage) of the original driving signal Aa. In detail, the signal As is highest in cases where the input voltage is a moderate value and falls as the input voltage increases from the moderate value or decreases from the moderate value.

In addition, the slope of the triangular waveform of the signal As is substantially equal when rising (when the voltage is rising) or falling (when the voltage is falling) if the input voltage is around a moderate value. For this reason, the duty ratio of the modulation signal Ms, which is the result of comparing the voltage thresholds Vth1 and Vth2 using the comparator 514, is approximately 50%. The downward slope of the signal As becomes flatter as the input value is raised from the moderate value. For this reason, the duty ratio becomes higher as the time period over which the modulation signal Ms is at the H level becomes relatively longer. On the other hand, the upward slope of the signal As becomes flatter as the input value is lowered from the moderate value. For this reason, the duty ratio becomes smaller as the time period over which the modulation signal Ms is at the H level becomes relatively shorter.

For this reason, the modulation signal Ms becomes a pulse density modulation signal as in the following manner. That is, the duty ratio of the modulation signal Ms is approximately 50% with the input value at the moderate value, increases as the input value is raised from the moderate value, and falls as the input value is lowered from the moderate value.

The first gate driver 521 turns the first transistor M1 on and off based on the modulation signal Ms. That is, the first gate driver 521 turns the first transistor M1 on if the modulation signal Ms is at a H level and turns the first transistor M1 off if the modulation signal Ms is at a L level. The second gate driver 522 turns the second transistor M2 on and off based on the logic inversion signal of the modulation signal Ms. That is, the second gate driver 522 turns the second transistor M2 off if the modulation signal Ms is at a H level and turns the second transistor M2 on if the modulation signal Ms is at a L level.

Accordingly, since the voltage of the driving signal COM-A, where the amplified modulation signal at the connection point of the first transistor M1 and the second transistor M2 is smoothed using the inverter L1 and the capacitor C1, increases as the duty ratio of the modulation signal Ms is raised and falls as the duty ratio of the modulation signal Ms is lower, the driving signal COM-A is controlled and output as a result of this so as to be a signal where the voltage of the original driving signal Aa becomes larger.

There is an advantage in that the width of variation in the duty ratio is taken to be larger in comparison to pulse width modulation where the modulation frequency is fixed since the drive circuit 50 uses pulse density modulation.

That is, it is only possible to secure a specific range (for example, a range from 10% to 90%) as the width of variation in the duty ratio in pulse width modulation with a fixed frequency since the minimum positive pulse width and negative pulse width which are possible when dealing with the entire circuitry is limited by the characteristics of the circuitry. In contrast to this, it is possible for the duty ratio to be larger over a region where the input voltage is high and it is possible for the duty ratio to be smaller over a region where the input voltage is low since the oscillation frequency is lower as the input voltage is father from the moderate value in pulse density modulation. For this reason, it is possible to secure a wider range (for example, a range from 5% to 95%) as the width of variation in the duty ratio in pulse width modulation with self-excited oscillation.

In addition, the drive circuit 50 is self-oscillating and a circuit which generates carrier waves at a high frequency such as separately-excited oscillation is not necessary. For this reason, there is an advantage in that integration of the circuits other than the circuits which handle high voltages, that is, the sections of the integrated circuit apparatus 500, is easy.

Additionally, since there is not only a path via the terminal Vfb as the feedback path for the driving signal COM-A in the drive circuit 50 but also a path where the high-frequency components are fed back via the terminal Ifb, the delays over the whole of the circuitry is reduced. For this reason, it is possible for the drive circuit 50 to generate the driving signal COM-A more precisely since the frequency of the self-excited oscillation is higher.

Returning to FIG. 7, the resistor R1, the resistor R2, the first transistor M1, the second transistor M2, the capacitor C5, the diode D10, and the low pass filter 560 are configured in the example which is shown in FIG. 7 as the output circuit 550 which outputs a capacitive load (the piezoelectric element 60) by generating an amplified control signal based on the modulation signal and generating a driving signal based on the amplified control signal.

The first power source section 530 applies a signal to a terminal which is different to the terminal to which the driving signal from the piezoelectric element 60 is applied. The first power source section 530 is configured using, for example, a fixed voltage circuit such as a bandgap reference circuit. The first power source section 530 outputs a voltage VBS from a terminal Vbs. In the example which is shown in FIG. 7, the first power source section 530 generates the voltage VBS with the ground potential at the ground terminal Gnd as a reference.

The booster circuit 540 supplies the power source to the gate driver 520. In the example which is shown in FIG. 7, the booster circuit 540 boosts the voltage Vdd which is supplied from the power source terminal Vdd with the ground potential at the ground terminal Gnd as a reference and generates the voltage Vm which is the power source voltage on the high side of the second gate driver 522. It is possible for the booster circuit 540 to be configured using a charge pump circuit, a switching regulator, or the like, but it is possible to suppress the generation of noise when the booster circuit 540 is configured using a charge pump circuit compared to a case where the booster circuit 540 is configured using a switching regulator. For this reason, it is possible to improve the liquid discharge accuracy since it is possible for the drive circuit 50 to generate the driving signal COM-A more precisely and it is possible to control the voltage which is applied to the piezoelectric element 60 with high precision. In addition, the power source generating section of the gate driver 520 is able to be mounted in the integrated circuit apparatus 500 since the power source generating section of the gate driver 520 is reduced in size by being configured using a charge pump circuit, and it is possible to significantly reduce the overall circuitry area of the drive circuit 50 compared to a case where the power source generating section of the gate driver 520 is configured outside of the integrated circuit apparatus 500.

1.6 Configuration of Discharge Selecting Section

Figure 9:
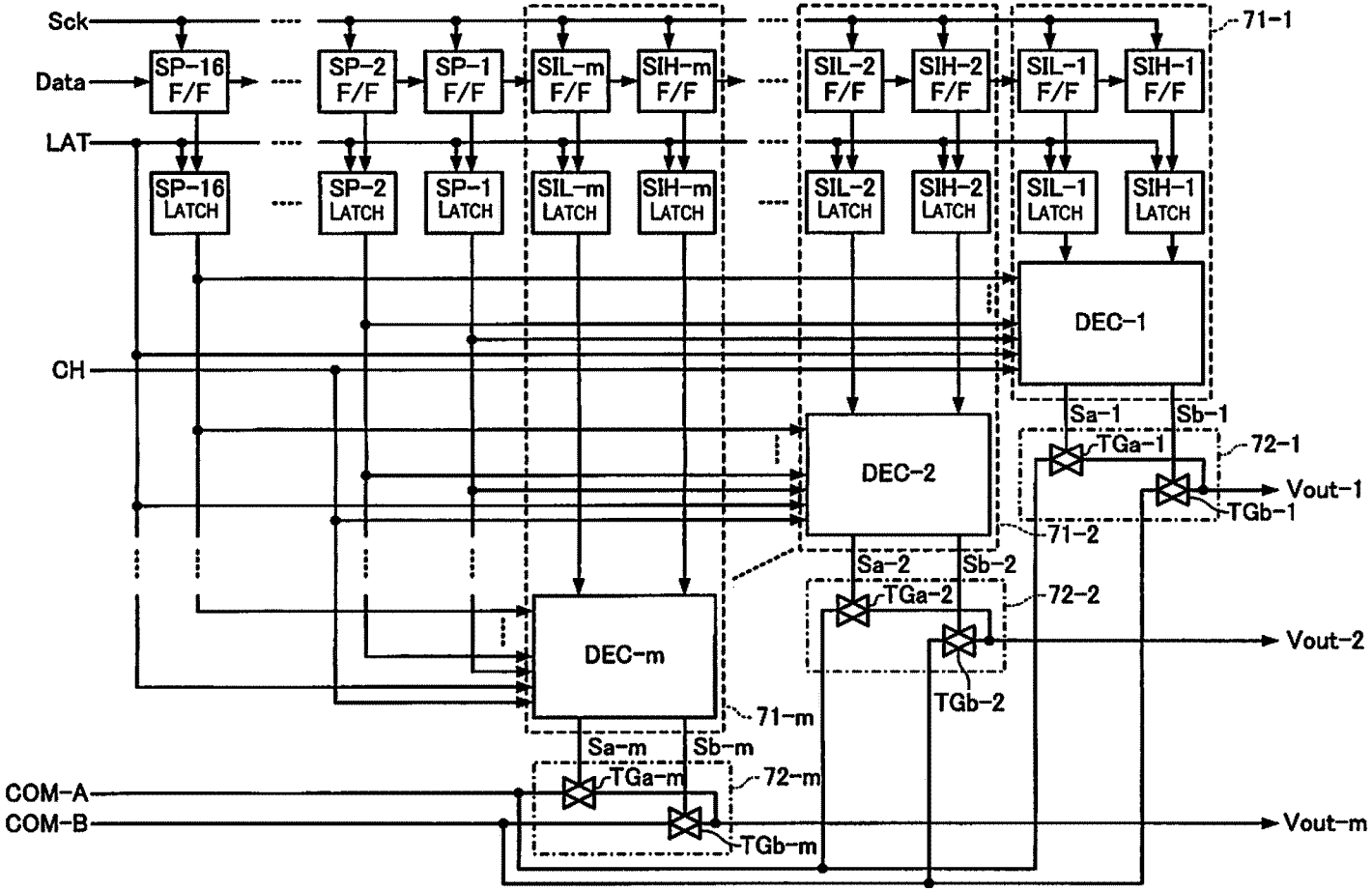
FIG. 9 is a diagram illustrating a functional configuration of a discharge selecting section.

FIG. 9 is a diagram illustrating a functional configuration of the discharge selecting section 70. As shown in FIG. 9, the discharge selecting section 70 includes the 16-bit SP shift register which is configured using 16 flip flops (F/F) for holding the 16 bits of the program data SP (SP-1 to SP-16). The data signal Data is input into the flip flop which is arranged at the initial stage of the SP shift register in order to hold the program data SP-16

In addition, the discharge selecting section 70 includes the 2m-bit SI shift register where 2m number of flip flops (F/F), which are for respectively holding 2 bits of printing data with regard to the mth of the discharge sections 600 (SIL-m, SIH-m), . . . , 2 bits of printing data with regard to the second of the discharge sections 600 (SIL-2, SIH-2), and 2 bits of printing data with regard to the first of the discharge sections 600 (SIL-1, SIH-1), are connected in order. The 2m-bit SI shift register is arranged at the final stage of the 16-bit SP shift register.

Then, in the 16 flip flops which configure the SP shift register and the 2m flip flops which configure the 2m-bit SI shift register, the clock signal Sck is input in common and the data signal Data is taken in while shifted one bit at a time at the timing of the edge of the clock signal Sck. Accordingly, data which is held by the SP shift register and the SI shift register is updated by forwarding of the data signal Data.

In the present embodiment, the data signal Data which is sent from the control section 100 over the cycle Ta includes the 2m bits of the printing data SI and the 16 bits of the program data SP. In addition, the clock signal Sck which includes the 2m+16 pulses is sent from the control section 100 to synchronize each piece of data in the data signal Data. Accordingly, the 2m bits of printing data SI are held in the SI shift register and the 16 bits of program data SP are held in the SP shift register at a timing of the last (2m+16th) pulse which is included in the clock signal Sck.

In addition, as shown in FIG. 9, the discharge selecting section 70 includes the 16-bit SP latch which is configured using a SP-1 latch to a SP-16 latch. In addition, the discharge selection section 70 includes the 2m-bit SI latch which is configured by a SIH-1 latch, a SIL-1 latch, a SIH-2 latch, a SIL-2 latch, . . . , a SIH-m latch, and a SIL-m latch. The control signal LAT is input in common into the SP-1 latch to the SP-16 latch which configure the SP latch and the SIH-1 latch, the SIL-1 latch, the SIH-2 latch, the SIL-2 latch, . . . , the SIH-m latch, and the SIL-m latch which configure the SI latch.

Then, the program data SP (SP-1 to SP-16) which is held at the SP shift register is taken into the SP latch (the SP-1 latch to the SP-16 latch) at a timing of the edge of the control signal LAT. In the same manner, the 2m bits of printing data SI (SIH-1, SIL-1, SIH-2, SIL-2, . . . , SIH-m, SIL-m) which is held at the SI shift register is taken into the SI latch (the SIH-1 latch, the SIL-1 latch, the SIH-2 latch, the SIL-2 latch, . . . , the SIH-m latch, and the SIL-m latch) at a timing of the edge of the control signal LAT.

Figure 10:
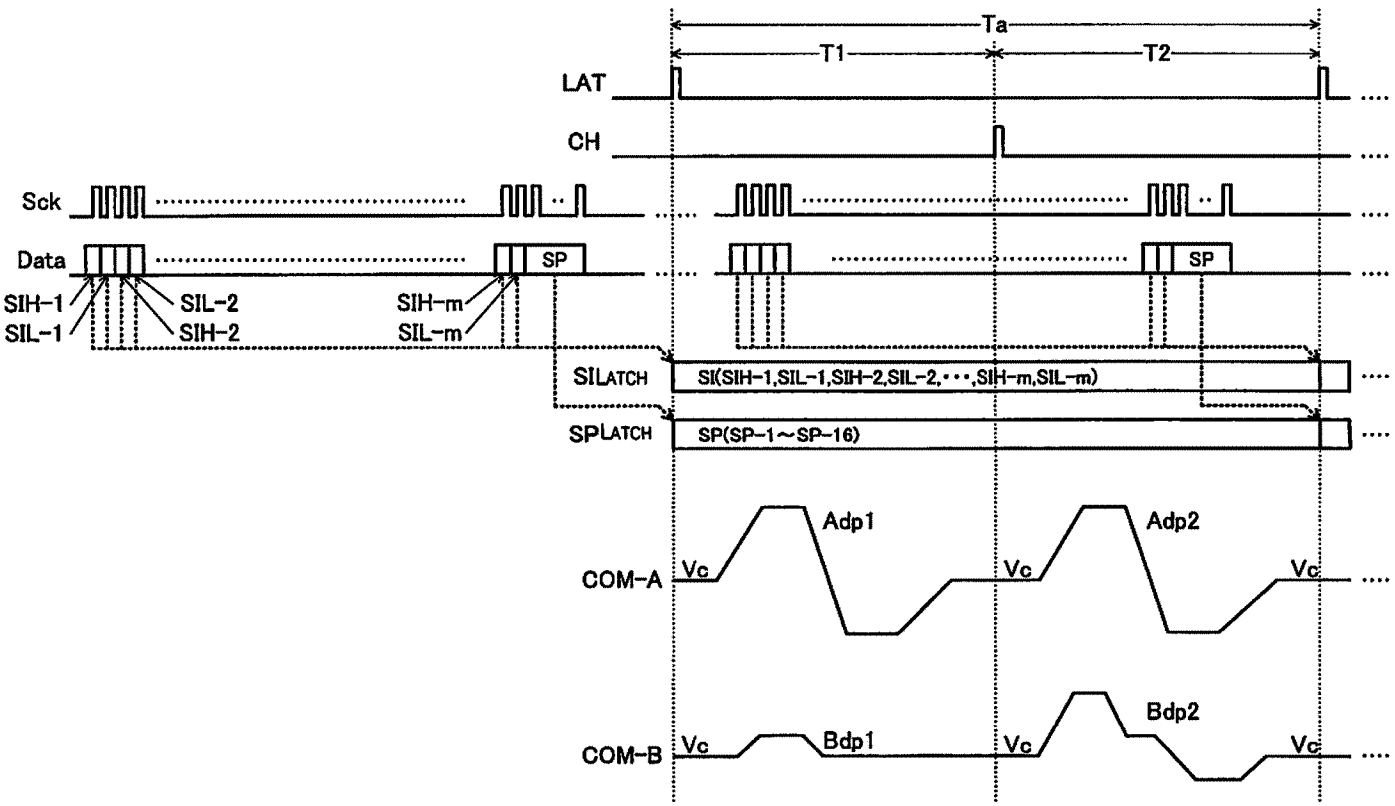
FIG. 10 is a diagram illustrating waveforms for various types of signals which are supplied to the discharge selecting section and update timings for various types of latches.

As described above, the pulses of the control signal LAT are sent from the control section 100 over each of the cycles Ta for printing. Accordingly, the program data SP which is held by the SP latch and the printing data SI which is held by the SI latch are updated using the control signal LAT over each of the cycles Ta for printing. FIG. 10 is a diagram illustrating waveforms for various types of signals which are supplied from the control unit 10 to the discharge selecting section 70 and update timings for the SP latch and the SI latch.

In addition, as shown in FIG. 9, the discharge selecting section 70 includes m number of decoders DEC-1 to DEC-m. The control signal LAT, the control signal CH, and the program data SP-1 to SP-16 which are taken into the SP-1 latch to the SP-16 latch are input in common to the m number of the decoders DEC-1 to DEC-m. In addition, the two bits of printing data (SIH-i and SIL-i) which are taken into the SIH-i latch and the SIL-i latch are input into an ith decoder DEC-i (where i is any out of 1 to m). Then, the decoder DEC-i outputs a control signal Sa-i which controls the selection or non-selection of the driving signal COM-A and a control signal Sb-i which controls the selection or non-selection of the driving signal COM-B in accordance with specific decoding logic. In the present embodiment, the decoding logic for the m number of the decoders DEC-1 to DEC-m is the same.

The driving signal COM-A or the driving signal COM-B which is selected using the control signal Sa-i or the control signal Sb-i is output from the discharge selecting section 70 as a driving signal Vout-i via transmission gates (analogue switches) TGa-i and TGb-i.

In FIG. 9, a waveform selecting signal generating circuit 71-1 is configured using the SIH-1 flip flop, the SIL-1 flip flop, the SIH-1 latch, the SIL-1 latch, and the decoder DEC-1, and the waveform selecting signal generating circuit 71-1 generates control signals Sa-1 and Sb-1 for generating a driving signal Vout-1 based on the data signal Data. In addition, a waveform selecting signal generating circuit 71-2 is configured using the SIH-2 flip flop, the SIL-2 flip flop, the SIH-2 latch, the SIL-2 latch, and the decoder DEC-2, and the waveform selecting signal generating circuit 71-2 generates control signals Sa-2 and Sb-2 as the second waveform selecting signals for generating a driving signal Vout-2 based on the data signal Data. Then, the discharge selecting section 70 includes a plurality (m number) of waveform selecting signal generating circuits 71-1 to **71-*m*** which are configured in the same manner.

In addition, in FIG. 9, a driving signal selecting circuit 72-1 is configured using the transmission gates TGa-1 and TGb-1, and the driving signal selecting circuit 72-1 selects a waveform which is included among the driving signals COM-A and COM-B based on the control signals Sa-1 and Sb-1 and applies the driving signal Vout-1 which includes the waveform which is selected to the first of the discharge sections 600. In addition, a driving signal selecting circuit 72-2 is configured using the transmission gate TGa-2 and the transmission gate TGb-2, and the driving signal selecting circuit 72-2 selects a waveform which is included among the driving signals COM-A and COM-B based on the control signals Sa-2 and Sb-2 and applies the driving signal Vout-2 which includes the waveform which is selected to the second of the discharge sections 600. Then, the discharge selecting section 70 includes a plurality (m number) of driving signal selecting circuit 72-1 to **72-*m*** which are configured in the same manner.

FIG. 11 is a diagram illustrating a table which shows the decoding logic of the decoder DEC-i. In the present embodiment, the program data SP-1 to SP-4 are fixed at (1, 0, 1, 0), the program data SP-5 to SP-8 are fixed at (1, 0, 0, 1), the program data SP-9 to SP-12 are fixed at (0, 0, 0, 1), and the program data SP-13 to SP-16 are fixed at (0, 1, 0, 0) as shown in FIG. 11.

When the two bits of printing data (SIH-i and SIL-i) are (1, 1), the control signal Sa-i is at a high level in accordance with the program data SP-1 (=1) and the control signal Sb-i is at a low level in accordance with the program data SP-2 (=0) at the time period T1 from when the control signal LAT rises up to when the control signal CH rises up. As a result, the driving signal COM-A (the trapezoidal waveform Adp1) is selected as the driving signal Vout-i at the time period T1. In addition, the control signal Sa-i is at a high level in accordance with the program data SP-3 (=1) and the control signal Sb-i is at a low level in accordance with the program data SP-4 (=0) at the time period T2 from when the control signal CH rises up to when the next control signal LAT rises up. As a result, the driving signal COM-A (the trapezoidal waveform Adp2) is selected as the driving signal Vout-i at the time period T2. Accordingly, when the two bits of printing data (SIH-i and SIL-i) are (1, 1), the driving signal Vout-i which corresponds to "large dot" which is shown in FIG. 6 is generated.

When the two bits of printing data (SIH-i and SIL-i) are (1, 0), the control signal Sa-i is at a high level in accordance with the program data SP-5 (=1) and the control signal Sb-i is at a low level in accordance with the program data SP-6 (=0) at the time period T1. As a result, the driving signal COM-A (the trapezoidal waveform Adp1) is selected as the driving signal Vout-i at the time period T1. In addition, the control signal Sa-i is at a low level in accordance with the program data SP-7 (=0) and the control signal Sb-i is at a high level in accordance with the program data SP-8 (=1) at the time period T2. As a result, the driving signal COM-B (the trapezoidal waveform Bdp2) is selected as the driving signal Vout-i at the time period T2. Accordingly, when the two bits of printing data (SIH-i and SIL-i) are (1, 0), the driving signal Vout-i which corresponds to "medium dot" which is shown in FIG. 6 is generated.

When the two bits of printing data (SIH-i and SIL-i) are (0, 1), the control signal Sa-i is at a low level in accordance with the program data SP-9 (=0) and the control signal Sb-i is at a low level in accordance with the program data SP-10 (=0) at the time period T1. As a result, neither the driving signal COM-A or the driving signal COM-B is selected at the time period T1, and the driving signal Vout-i is held at the voltage Vc which is the voltage prior to this using the capacity of the piezoelectric element 60 although one end of the piezoelectric element 60 is open. In addition, the control signal Sa-i is at a low level in accordance with the program data SP-11 (=0) and the control signal Sb-i is at a high level in accordance with the program data SP-12 (=1) at the time period T2. As a result, the driving signal COM-B (the trapezoidal waveform Bdp2) is selected as the driving signal Vout-i at the time period T2. Accordingly, when the two bits of printing data (SIH-i and SIL-i) are (0, 1), the driving signal Vout-i which corresponds to "small dot" which is shown in FIG. 6 is generated.

When the two bits of printing data (SIH-i and SIL-i) are (0, 0), the control signal Sa-i is at a low level in accordance with the program data SP-13 (=0) and the control signal Sb-i is at a high level in accordance with the program data SP-14 (=1) at the time period T1. As a result, the driving signal COM-B (the trapezoidal waveform Bdp1) is selected as the driving signal Vout-i at the time period T1. In addition, the control signal Sa-i is at a low level in accordance with the program data SP-15 (=0) and the control signal Sb-i is at a low level in accordance with the program data SP-16 (=0) at the time period T2. As a result, neither the driving signal COM-A or the driving signal COM-B is selected at the time period T2, and the driving signal Vout-i is held at the voltage Vc which is the voltage prior to this using the capacity of the piezoelectric element 60 although one end of the piezoelectric element 60 is open. Accordingly, when the two bits of printing data (SIH-i and SIL-i) are (0, 0), the driving signal Vout-i which corresponds to "no recording" which is shown in FIG. 6 is generated.

Here, the discharge selection section 70 may be an integrated circuit apparatus.

1-7. Configuration of Flexible Flat Cable Grouping and Structuring of Connection Between Head Unit and Flexible Flat Cable Grouping A portion of the ink which is discharged from the discharge sections 600 becomes mist and is suspended in air before landing on the printing medium P and a portion of the ink which lands on the printing medium P is also re-suspended and becomes mist before solidifying on the printing medium P. It is easy for the mist which is suspended in this manner to become attached to the flexible flat cable 190 which supplies the driving signals COM-A and COM-B which are extremely high voltages (for example, 42 V) from the control unit 10 to the head unit 20 and generates static electricity by rubbing against various sections inside the casing of the liquid discharge apparatus 1. Then, when the mist which becomes attached to the flexible flat cable 190 condenses, becomes droplets, and enters into inner sections of the head unit 20, there is a concern that electrical faults will be generated in the circuits such as the discharge selecting section 70 and the circuits will be damaged.

Therefore, in the present embodiment, a special design is adopted for the configuration of the flexible flat cable grouping 200 and the structuring of the connection between the head unit 20 and the flexible flat cable grouping 200 in order to effectively suppress the liquid which is discharged from entering into inner sections of the head unit 20.

Figure 12C:
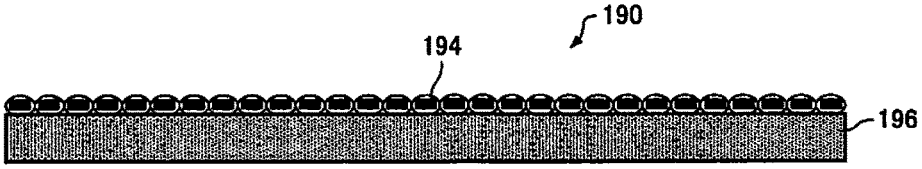
FIG. 12C is a cross sectional diagram of a flexible flat cable which is cut along A-A' in FIG. 12A and FIG. 12B.

FIG. 12A, FIG. 12B, and FIG. 12C are diagrams illustrating structures in the vicinity of the end section (the end section on the side which is connected to the head unit 20) of the flexible flat cable 190 which is included in the flexible flat cable grouping 200. FIG. 12A is a planar diagram of a first surface 191 of the flexible flat cable 190, and FIG. 12B is a planar diagram of a second surface 192 of the flexible flat cable 190 which is on the reverse side of the first surface 191. In addition, FIG. 12C is a cross sectional diagram of the flexible flat cable 190 which is cut along A-A' in FIG. 12A and FIG. 12B.

The flexible flat cable 190 is configured using, for example, two sheets of film tape being adhered so as to interpose a plurality of core lines which line up with specific spacing. Accordingly, there are concavities and convexities in the first surface 191 and the second surface 192 of the flexible flat cable 190 along the plurality of core lines. That is, the flexible flat cable 190 has grooves 193 in the first surface 191 and the second surface 192. As shown in FIG. 12C, the plurality of core lines function as the signal lines 194 and a portion of the plurality of core lines function as the driving signal line 194D (refer to FIG. 2) and the control signal line 194C (refer to FIG. 2).

In addition, as shown in FIG. 12A, the plurality of core lines are in a state of being exposed so the film tape is not covered in the vicinity of the end section of the first surface 191 of the flexible flat cable 190 and the plurality of signal output terminals 195 are formed. That is, the plurality of signal output terminals 195 which include the driving signal output terminal 195D (refer to FIG. 2) and the control signal output terminal 195C (refer to FIG. 2) are provided in the first surface 191 of the flexible flat cable 190.

On the other hand, as shown in FIG. 12B, the plurality of signal output terminals 195 which include the driving signal output terminal 195D (refer to FIG. 2) and the control signal output terminal 195C (refer to FIG. 2) are not provided in the second surface 192 of the flexible flat cable 190. In addition, the end section of the second surface 192 of the flexible flat cable 190 is covered by the film tape and a reinforcing plate 196 is adhered to the film tape in the vicinity of the end section. That is, the signal output terminals 195 is not provided but the reinforcing plate 196 is provided in the second surface 192 of the flexible flat cable 190. The thickness of the end section of the flexible flat cable 190 is increased due to the reinforcing plate 196, connection between the end section of the flexible flat cable 190 and the connection sections 203 (refer to FIG. 2) of the head unit 20 is easier, there are no gaps with the connection sections 203 in a state of being connected, and it is difficult for the flexible flat cable 190 to be removed. The reinforcing plate 196 is configured using, for example, plastic and has an ability to repeal water which is greater than the flexible flat cable 190. In addition, the surface of the reinforcing plate 196 is flat and does not have grooves.

As described above, the various types of signal which are generated by the control unit 10 are supplied to the head unit 20 using the flexible flat cable grouping 200 which includes the plurality of flexible flat cables 190. There will be description below where the various types of signals are supplied to the head unit 20 using the flexible flat cable grouping 200 which has two of the flexible flat cables 190 (a first flexible flat cable 190*a* and a second flexible flat cable 190*b*) which both have the structure which is shown in FIG. 12A, FIG. 12B, and FIG. 12C.

Figure 13A:
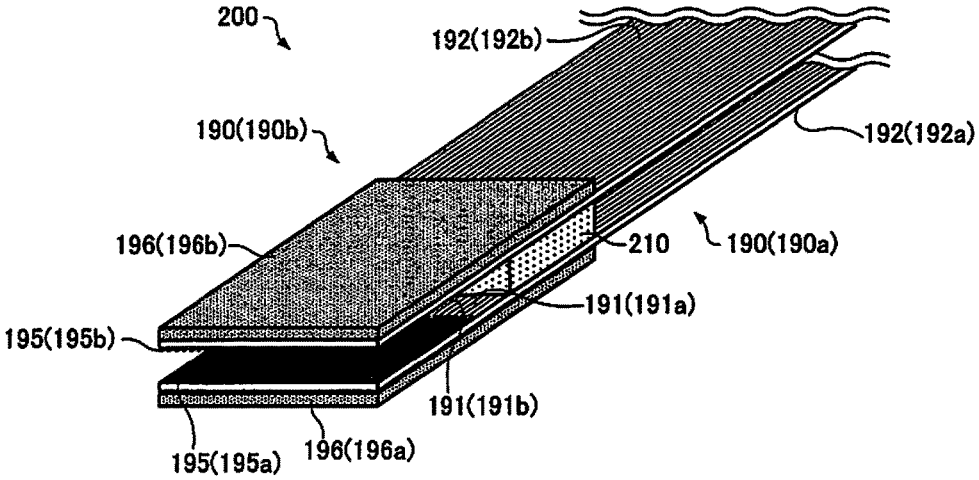
FIG. 13A is a perspective diagram of the vicinity of an end section of a flexible flat cable grouping.
Figure 13B:
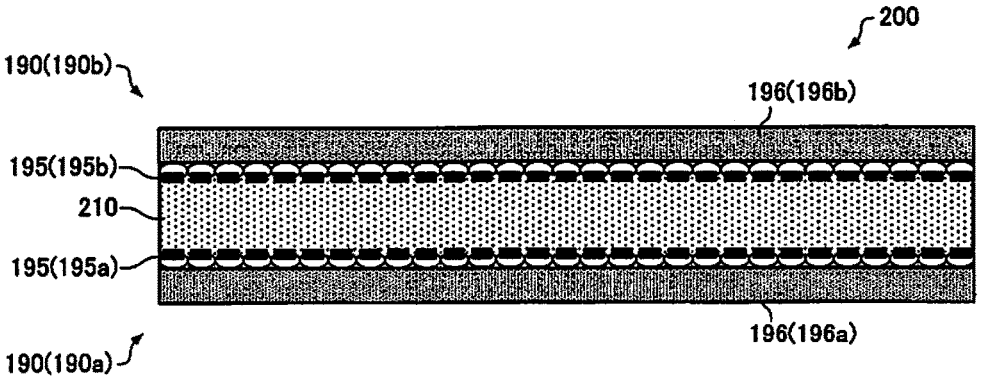
FIG. 13B is a diagram illustrating an end section of a flexible flat cable grouping.

FIG. 13A is a perspective diagram of the vicinity of the end section (the end section on the side which is connected to the head unit 20) of the flexible flat cable grouping 200. In addition, FIG. 13B is a diagram illustrating the end section (the end section on the side which is connected to the head unit 20) of the flexible flat cable grouping 200. As shown in FIG. 13A and FIG. 13B, in the first flexible flat cable 190*a*, a plurality of signal output terminals 195*a* are provided in a first surface 191*a* and a reinforcing plate 196*a* is provided in a second surface 192*a*. In the same manner, in the second flexible flat cable 190*b*, a plurality of signal output terminals 195*b* are provided in a first surface 191*b* and a reinforcing plate 196*b* is provided in a second surface 192*b*. Then, the first surface 191*a* of the first flexible flat cable 190*a* and the first surface 191*b* of the second flexible flat cable 190*b* oppose each other, and the first flexible flat cable 190*a* and the second flexible flat cable 190*b* are arranged to be parallel to each other.

In addition, the flexible flat cable grouping 200 includes a liquid absorbing member 210 which is provided between the first flexible flat cable 190*a* and the second flexible flat cable 190*b*. In detail, the liquid absorbing member 210 is provided between the first surface 191*a* of the first flexible flat cable 190*a* and the first surface 191*b* of the second flexible flat cable 190*b* so as to come into contact with the first surface 191*a* and the first surface 191*b* and not come into contact with (be in a position separated from) the signal output terminals 195*a* and the signal output terminals 195*b*. The liquid absorbing member 210 is preferably provided at a position which is as close as possible to the signal output terminals 195*a* and the signal output terminals 195*b*. It is sufficient if the liquid absorbing member 210 is a member which is able to absorb liquid and may be, for example, sponge, cotton, pulp, cloth, or the like. In particular, sponge which is a material where absorbency of liquid is high is particularly appropriate as the liquid absorbing member 210.

The flexible flat cable grouping 200 is configured in the following manner.

Figure 14A:
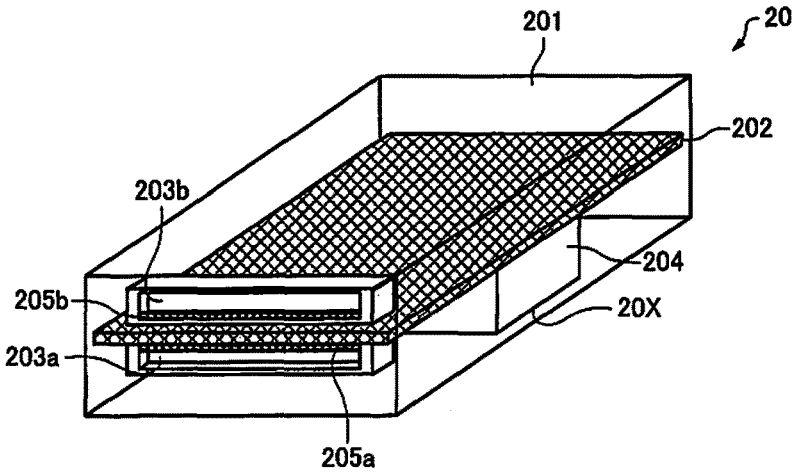
FIG. 14A is a perspective diagram (a transparent view) of a head unit.
Figure 14B:
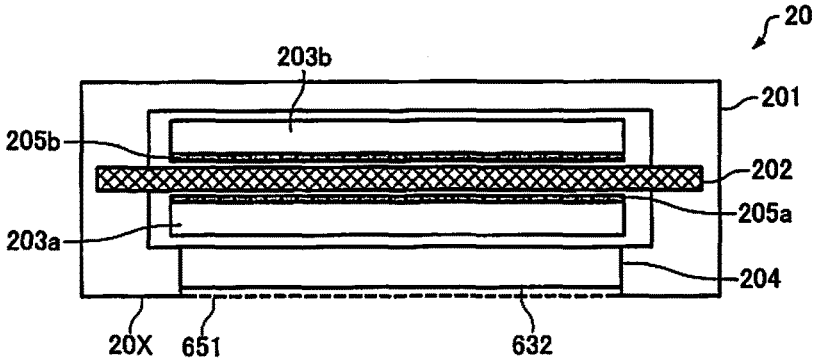
FIG. 14B is a diagram illustrating a connection surface of a head unit which is connected to a flexible flat cable grouping.
Figure 14C:
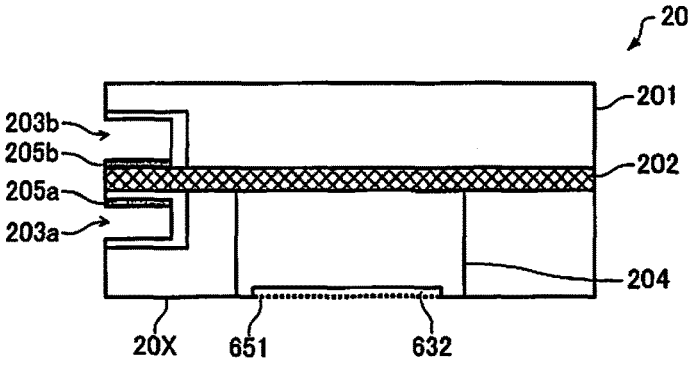
FIG. 14C is a side surface diagram (a transparent view) of a head unit.

FIG. 14A, FIG. 14B, and the FIG. 14C are diagrams illustrating the structure of the head unit 20. FIG. 14A is a perspective diagram (a transparent view) of the head unit 20, FIG. 14B is a diagram illustrating a connection surface of the head unit 20 which is connected to the flexible flat cable grouping 200, and FIG. 14C is a side surface diagram (a transparent view) of the head unit 20.

As shown in FIG. 14A, FIG. 14B, and FIG. 14C, the head unit 20 includes a substrate 202 where the discharge selecting section 70 which is not shown in the diagrams and the like are mounted on the upper surface (the surface on the opposite side to the printing medium P), a head section 204, a casing 201 in which the substrate 202 and the head section 204 are contained, and a first connection section 203*a* and a second connection section 203*b* which are two of the connection sections 203 (refer to FIG. 2) which are provided on a side surface of the head unit 20 (the casing 201).

The head section 204 has a structure which is shown in FIG. 3 and is attached to the lower surface of the substrate 202 (the surface on the same side as the printing medium P). The nozzle plate 632, which is a plate which has the nozzles 651 which are discharges opening where liquid is discharged, is provided on a lower section of the head section 204 (an end section on the print medium P side) (refer to FIG. 3). That is, the lower surface of the head unit 20 (the casing 201) (the surface which opposes the printing medium P) is a discharge surface 20X which is provided with the discharge opening where liquid is discharged.

The first connection section 203*a* is connected to the first flexible flat cable 190*a* and the second connection section 203*b* is connected to the second flexible flat cable 190*b*. The first connection section 203*a* has an open section and signal input terminals 205*a* which number as many as the signal output terminals 195*a* of the first flexible flat cable 190*a* are provided in the upper surface of the first connection section 203*a*. In the same manner, the second connection section 203*b* has an open section and signal input terminals 205*b* which number as many as the signal output terminals 195*b* of the second flexible flat cable 190*b* are provided in the lower surface of the second connection section 203*b*.

Figure 15A:
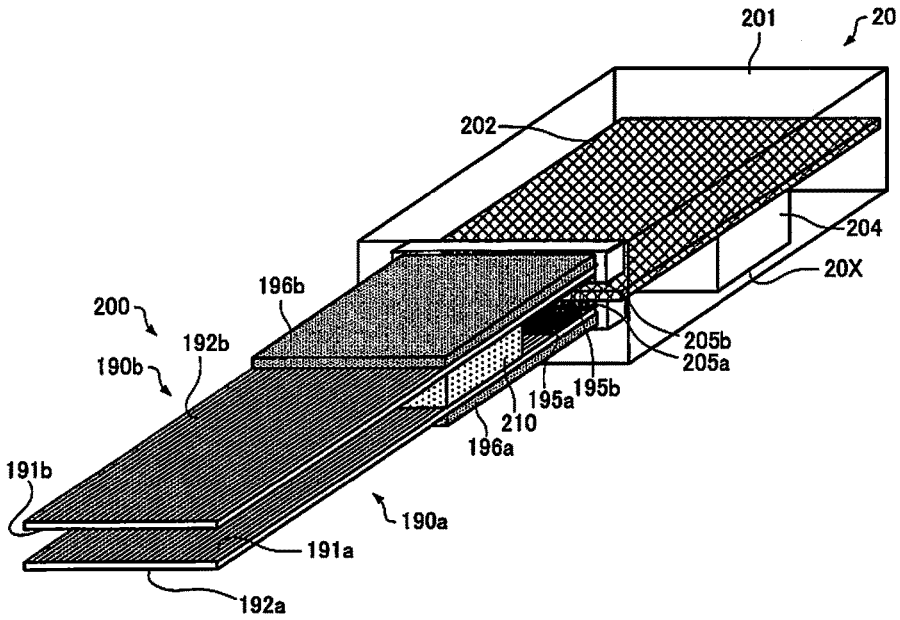
FIG. 15A is a perspective diagram (a transparent view) of a head unit which is connected to a flexible flat cable grouping.
Figure 15B:
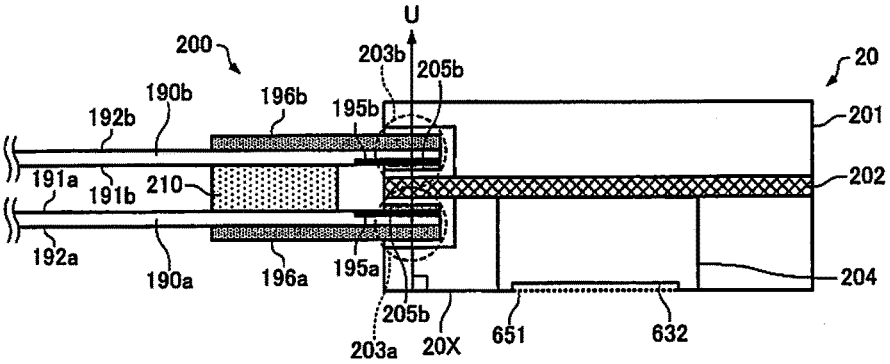
FIG. 15B is a side surface diagram (a transparent view) of a head unit which is connected to a flexible flat cable grouping.

FIG. 15A and FIG. 15B are diagrams illustrating the state where the flexible flat cable grouping 200 (the first flexible flat cable 190*a* and the second flexible flat cable 190*b*) are connected to the connection sections 203 (the first connection section 203*a* and the second connection section 203*b*) of the head unit 20. FIG. 15A is a perspective diagram (a transparent view) of the head unit 20 which is connected to the flexible flat cable grouping 200, and FIG. 15B is a side surface diagram (a transparent view) of the head unit 20 which is connected to the flexible flat cable grouping 200.

As shown in FIG. 15A and FIG. 15B, the first flexible flat cable 190*a* is connected to the head unit 20 due to the end section of the first flexible flat cable 190*a* (the end section where the signal output terminals 195*a* are provided) fitting together with the open sections of the first connection section 203*a* of the head unit 20. Then, the plurality of signal output terminals 195*a* which are provided in the first surface 191*a* of the first flexible flat cable 190*a* respectively come into contact with the plurality of signal input terminals 205*a* which are provided in the first connection section 203*a* of the head unit 20. In the same manner, the second flexible flat cable 190*b* is connected to the head unit 20 due to the end section of the second flexible flat cable 190*b* (the end section where the signal output terminals 195*b* are provided) fitting together with the open sections of the second connection section 203*b* of the head unit 20. Then, the plurality of signal output terminals 195*b* which are provided in the first surface 191*b* of the second flexible flat cable 190*b* respectively come into contact with the plurality of signal input terminals 205*b* which are provided in the second connection section 203*b* of the head unit 20. Due to this, the control section 100 and the discharge selecting section 70 are electrically connected and the various types of signals from the control unit 10 are supplied to the discharge selecting section 70 via the first flexible flat cable 190*a* or the second flexible flat cable 190*b*.

Images are formed on the surface of the printing medium P by liquid being discharged while the head unit 20 slides in a state where the flexible flat cable grouping 200 is connected in this manner. At this time, a portion of the liquid which lands on the printing medium P is turned into mist and is suspended due to an air flow which is generated by the sliding of the head unit 20. The liquid which is turned into mist becomes attached to the first flexible flat cable 190*a* and the second flexible flat cable 190*b*. Then, since the first flexible flat cable 190*a* and the second flexible flat cable 190*b* sway in accompaniment with the sliding of the head unit 20, it is easy for the mist which becomes attached to the first flexible flat cable 190*a* and the second flexible flat cable 190*b* to condense, become droplets, and flow in the direction of the first connection section 203*a* and the second connection section 203*b* of the head unit 20.

Therefore, in the present embodiment, the liquid absorbing member 210 is provided between the first surface 191*a* of the first flexible flat cable 190*a* and the first surface 191*b* of the second flexible flat cable 190*b*, and the liquid which becomes attached to the first surface 191*a* and the first surface 191*b* and flows in the direction of the first connection section 203*a* and the second connection section 203*b* is absorbed by the liquid absorbing member 210 as shown in FIG. 15A and FIG. 15B. Then, it is difficult for the liquid to reach the plurality of signal output terminals 195*a* and 195*b* which include the driving signal output terminal 195D and the control signal output terminal 195C in the first flexible flat cable 190*a* and the second flexible flat cable 190*b* due to the functioning of the liquid absorbing member 210 since the plurality of signal output terminals 195*a* and 195*b* are provided on the first surfaces 191*a* and 191*b*. For this reason, it is difficult for electrical faults such as short circuiting, which are generated due to the liquid being attached to these terminals, to be generated.

Here, it is possible for the length and width of the liquid absorbing member 210 to be appropriately selected, but the width of the liquid absorbing member 210 is preferably the same as or greater than the widths (the lengths in the lateral direction) of the first flexible flat cable 190*a* and the second flexible flat cable 190*b* in order to more reliably suppress liquid from becoming attached to the signal output terminals 195*a* and 195*b*. In addition, the liquid absorbing member 210 is preferably as long as possible within a range such that there is no effect on driving of the first flexible flat cable 190*a* and the second flexible flat cable 190*b* in order to suppress liquid from becoming attached to the first flexible flat cable 190*a* and the second flexible flat cable 190*b*. In addition, there may be the one liquid absorbing member 210 or there may be a plurality of the liquid absorbing members 210.

In addition, it is easier for the liquid which is turned into mist to become attached to the first flexible flat cable 190*a* which is connected to the first connection section 203*a* which, out of the plurality of connection sections 203 of the head unit 20, is the closest to the discharge surface 20X of the head unit 20. Therefore, in the present embodiment, the first flexible flat cable 190*a* is connected to the first connection section 203*a* so that the first surface 191*a* faces the opposite side to the discharge surface 20X and the second surface 192*a* faces the same side as the discharge surface 20X as shown in FIG. 15B. In other words, the first flexible flat cable 190*a* is connected to the head unit 20 so that the second surface 192*a* is positioned in the first connection section 203*a* between the discharge surface 20X and the first surface 191*a* in a direction U which is orthogonal to the discharge surface 20X of the head unit 20. That is, the first flexible flat cable 190*a* is connected to the first connection section 203*a* so that the second surface 192*a* opposes the printing medium P and the first surface 191*a* does not oppose the printing medium P. Accordingly, a portion of the liquid which is discharged from the discharge opening which is provided in the discharge surface 20X of the head unit 20 is turned into mist, and it is easy for the mist to become attached to the second surface 192*a* of the first flexible flat cable 190*a* and it is difficult for the mist to become attached to the first surface 191*a* of the first flexible flat cable 190*a*. Then, it is difficult for the liquid to become attached to the plurality of signal output terminals 195*a* in the first flexible flat cable 190*a* since the plurality of signal output terminals 195*a* are provided on the first surface 191*a*. For this reason, it is difficult for electrical faults such as short circuiting, which are generated due to the liquid being attached to these terminals, to be generated.

Furthermore, it is easy for the liquid which becomes attached to the second surface 192*a* of the first flexible flat cable 190*a* to flow in the direction of the first connection section 203*a* along the grooves in the second surface 192*a*, but due to the reinforcing plate 196*a* being provided on the second surface 192*a*, the progress of the liquid toward the first connection section 203*a* is impeded by the reinforcing plate 196*a*. Furthermore, even if the liquid which becomes attached to the second surface 192*a* of the first flexible flat cable 190*a* were to reach the surface of the reinforcing plate 196*a* (the surface which opposes the printing medium P) or the liquid which is turned into mist were to become directly attached to the surface of the reinforcing plate 196*a*, the liquid which becomes attached to the reinforcing plate 196*a* would not be led towards the first connection section 203*a* along the grooves since there are no grooves in the reinforcing plate 196*a*. In addition, it is easy for the liquid which condenses and increases in weight to fall downward before reaching the first connection section 203*a* due to the ability of the reinforcing plate 196*a* to repeal water.

In this manner, according to the liquid discharge apparatus 1 as in the first embodiment, it is possible to effectively suppress electrical faults which are caused by the liquid which is discharged by adopting a special design for the configuration of the flexible flat cable grouping 200 and the structuring of the connection between the head unit 20 and the flexible flat cable grouping 200.

In addition, according to the liquid discharge apparatus 1 as in the first embodiment, it is possible to effectively suppress electrical faults which are caused by the liquid which is discharged without using a dedicated member other than the liquid absorbing member 210 for protecting the head unit 20 from liquid due to the reinforcing plate 196*a* which is provided on the second surface 192*a* of the first flexible flat cable 190*a* also acting as a member for preventing entry of the liquid into the head unit 20.

2. Second Embodiment

The liquid discharge apparatus 1 of a second embodiment has a configuration in the same manner as the liquid discharge apparatus 1 of the first embodiment and also adopts a special design for the configuration of the flexible flat cable grouping 200 so that it is more difficult for liquid to reach the signal output terminals 195*a* and 195*b* and the signal input terminals 205*a* and 205*b*.

Figure 16A:
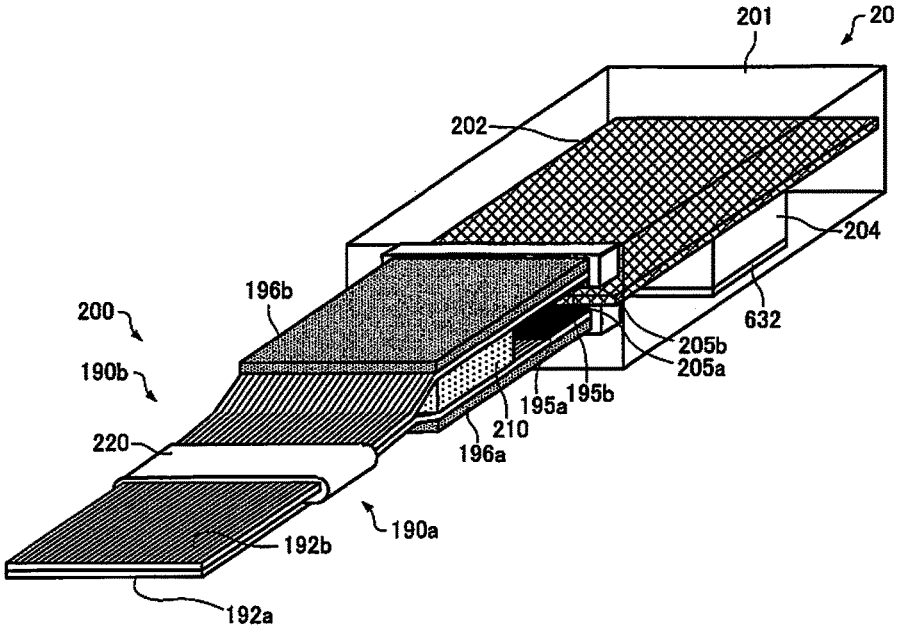
FIG. 16A is a perspective diagram (a transparent view) of a head unit which is connected to a flexible flat cable grouping of a second embodiment.
Figure 16B:
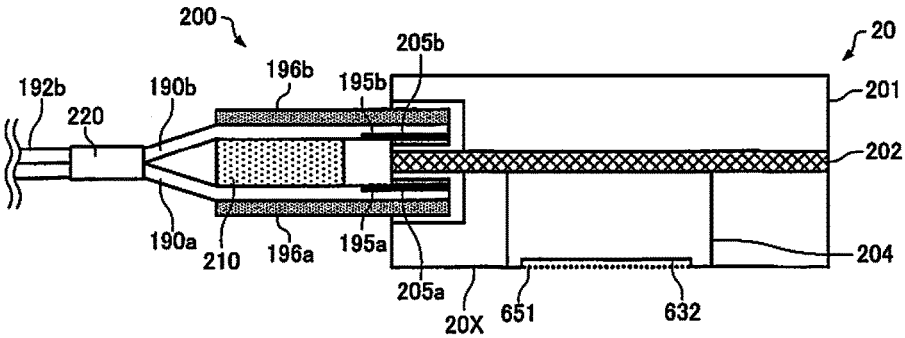
FIG. 16B is a side surface diagram (a transparent view) of a head unit which is connected to a flexible flat cable grouping of the second embodiment.

FIG. 16A is a perspective diagram (a transparent view) of the head unit 20 which is connected to the flexible flat cable grouping 200 in the second embodiment, and FIG. 16B is a side surface diagram (a transparent view) of the head unit 20 which is connected to the flexible flat cable grouping 200 in the second embodiment.

As shown in FIG. 16A and FIG. 16B, the flexible flat cable grouping 200 of the second embodiment includes a binding section 220 for binding the first flexible flat cable 190*a* and the second flexible flat cable 190*b*. In detail, the binding section 220 is provided so that the first surface 191*a* of the first flexible flat cable 190*a* and the first surface 191*b* of the second flexible flat cable 190*b* are brought into contact at a position which is close to the liquid absorbing member 210. Preferably, the binding section 220 is provided at a position which is as close as possible to the liquid absorbing member 210. For example, the binding section 220 may be various types of bands (tying bands, rubber bands, or the like) which bundle together the first surface 191*a* of the first flexible flat cable 190*a* and the first surface 191*b* of the second flexible flat cable 190*b* so as to bring the first surface 191*a* and the first surface 191*b* into contact with each other or may be an adhesive agent, adhesive tape, or the like which adheres the first surface 191*a* of the first flexible flat cable 190*a* and the first surface 191*b* of the second flexible flat cable 190*b*.

A portion of the liquid is turned into mist and is suspended when the liquid is discharged while the head unit 20 is sliding, but it is difficult for the liquid which is turned into mist to enter the contacting portion between the first surface 191*a* and the first surface 191*b* due to the binding section 220 in a state where the flexible flat cable grouping 200 is connected in this manner. In addition, it is difficult for the liquid, which is attached to the side which is farthest from the contacting portion with regard to the head section 20 in the first surface 191*a* and the first surface 191*b* and which flows toward in the direction of the first connection section 203*a* and the second connection section 203*b*, to pass through the contacting portion. Even if liquid were able to pass through the contacting portion or liquid were to become directly attached to the first surface 191*a* and the first surface 191*b* between the binding section 220 and the liquid absorbing member 210, the liquid which flows toward in the direction of the first connection section 203*a* and the second connection section 203*b* would be absorbed by the liquid absorbing member 210. Accordingly, it is difficult for the liquid to reach the signal output terminals 195*a* and 195*b* and the signal input terminals 205*a* and 205*b*. For this reason, it is difficult for electrical faults such as short circuiting, which are generated due to the liquid being attached to these terminals, to be generated. In this manner, according to the liquid discharge apparatus 1 as in the second embodiment, it is possible to effectively suppress electrical faults which are caused by the liquid which is discharged.

Furthermore, generation of static electricity due to rubbing of the first flexible flat cable 190*a* and the second flexible flat cable 190*b* is suppressed since the head unit 20 slides in a state where the first flexible flat cable 190*a* and the second flexible flat cable 190*b* are bound together by the binding section 220. As a result, it is difficult for liquid to become attached to the first flexible flat cable 190*a* and the second flexible flat cable 190*b*, and it is possible to suppress the effects on the control unit 10 and the head unit 20 due to static electricity which is generated by the first flexible flat cable 190*a* and the second flexible flat cable 190*b*. In this manner, according to the liquid discharge apparatus 1 as in the second embodiment, it is possible to effectively suppress electrical faults which are caused by static electricity which is generated by the first flexible flat cable 190*a* and the second flexible flat cable 190*b*.

Here, it is possible for the length and the number of the binding sections 220 to be appropriately selected, but it is preferable for there to be as many as possible of the portions where the first surface 191*a* of the first flexible flat cable 190*a* and the first surface 191*b* of the second flexible flat cable 190*b* are brought into contact in order to more reliably suppress the liquid from becoming attached to the signal output terminals 195*a* and 195*b*. In addition, it is possible for the positional relationship between the liquid absorbing member 210 and the binding section 220 to be appropriately selected, and the binding section 220 may be provided at a position which is closer to the signal output terminals 195*a* and 195*b* than the liquid absorbing member 210. In this case, the binding section 220 is preferably provided at a position which is as close as possible to the signal output terminals 195*a* and the signal output terminal 195*b* within a range of not coming into contact with the signal output terminals 195*a* and 195*b*. In addition, the liquid absorbing member 210 is preferably provided at a position which is as close as possible to the binding section 220.

3. Third Embodiment

In the liquid discharge apparatus 1 of the first embodiment, there are few concerns that liquid will enter the first connection section 203*a* or the second connection section 203*b* of the head unit 20 due to the configuration of the flexible flat cable grouping 200, the structuring of the connection between the head unit 20 and the flexible flat cable grouping 200, and the reinforcing plate 196*a* which is provided in the second surface 192*a* of the first flexible flat cable 190*a*, but even in a case where liquid were to enter, it would be easy for liquid to enter into the first connection section 203*a* or the second connection section 203*b* from both ends which are the narrowest and have a rectangular shape. That is, it would be easy for liquid to reach the signal output terminals 195*a* and 195*b* which are provided at both ends at the end sections of the first flexible flat cable 190*a* and the end sections of the second flexible flat cable 190*b* and the signal input terminals 205*a* and 205*b* which are provided at both ends of the first connection section 203*a* and the second connection section 203*b* of the head unit 20. In contrast to this, it would be difficult for liquid to reach the signal output terminals 195*a* and 195*b* which are provided near the middle of the end sections of the first flexible flat cable 190*a* and the end sections of the second flexible flat cable 190*b* and the signal input terminals 205*a* and 205*b* which are provided near the middle of the first connection section 203*a* and the second connection section 203*b* of the head unit 20.

Therefore, the liquid discharge apparatus 1 of a third embodiment has a configuration in the same manner as the liquid discharge apparatus 1 of the first embodiment and also adopts a special design where various types of signals are allocated to the plurality of signal output terminals 195*a* and 195*b* so that it would be difficult for the discharge selecting section 70 and the like to be damaged even if the liquid were to reach the signal output terminals 195*a* and 195*b* or the signal input terminals 205*a* and 205*b*.

FIG. 17 is a diagram illustrating one example of the signals being allocated to the signal output terminals 195*a* of the first flexible flat cable 190*a* or the signal output terminals 195*b* of the second flexible flat cable 190*b*. In FIG. 17, 1 to 29 in the left column are the terminal numbers for the signal output terminals 195*a* or the signal output terminals 195*b* and the right column is the names of the signals which are allocated. For example, the respective signal output terminals 195*a* or the respective signal output terminals 195*b* with terminal numbers 1 to 29 are provided in order from the left end of the flexible flat cable grouping 200 which is shown in FIG. 13B. In addition, the respective signal input terminals 205*a* and 205*b* which correspond to the respective signal output terminals 195*a* and 195*b* with terminal numbers 1 to 29 in FIG. 17 are provided in order from the right end of the head unit 20 which is shown in FIG. 14B.

As shown in FIG. 17, the driving voltages COM-A and COM-B which are high voltages are output from six of the signal output terminals 195*a* and 195*b* with the terminal numbers 10, 12, 14, 16, 18, and 20 which are closest to the center (farthest from the ends) where it is difficult for liquid to reach in the end sections of the first flexible flat cable 190*a* and the end sections of the second flexible flat cable 190*b*. That is, the driving signal line 194D is the signal line 194 out of the plurality of signal lines 194 other than the signal lines 194 which are positioned on the ends (on the ends in the short-side direction) in the first flexible flat cable 190*a* and the second flexible flat cable 190*b* and is preferably the signal line 194 which is positioned near the center. Accordingly, according to the liquid discharge apparatus 1 of the third embodiment, it is possible to effectively suppress damage from a large voltage being applied to circuits such as the discharge selecting section 70 due to the driving signal line 194D short circuiting the other signal lines 194 and the like.

In addition, as shown in FIG. 17, the ground signal GND which is a low voltage is output from two of the signal output terminals 195*a* and 195*b* with the terminal numbers 1 and 29 which are on both ends where it is easy for liquid to reach in the end sections of the first flexible flat cable 190*a* and the end sections of the second flexible flat cable 190*b*. That is, the signal lines which are positioned on the ends of the first flexible flat cable 190*a* and the ends of the second flexible flat cable 190*b* (on the ends in the short-side direction) are the ground lines. Accordingly, according to the liquid discharge apparatus 1 of the third embodiment, it is difficult for damage to occur and it is possible for the effect on the circuits to be reduced since a large voltage would not be applied to circuits such as the discharge selecting section 70 even if liquid were to reach the signal output terminals 195*a* and 195*b* which are farthest to the ends (the ground signal output terminals) in the first flexible flat cable 190*a* and the second flexible flat cable 190*b* and there were short circuiting of the ground line and the other signal lines 194.

In addition, as shown in FIG. 17, the clock signal Sck, the data signal Data, the control signals LAT and CH, the voltage VBS, and the ground signal GND which are signals with voltages which are lower than the driving signals COM-A and COM-B are output from the respective signal output terminals 195*a* and 195*b* with terminal numbers 2 to 9 and 21 to 29 between the six signal output terminals 195*a* and 195*b* with the terminal numbers 10, 12, 14, 16, 18, and 20 which output the driving voltages COM-A and COM-B and the two signal output terminals 195*a* and 195*b* with the terminal numbers 1 and 29 which are on both ends at the ends of the first flexible flat cable 190*a* and the second flexible flat cable 190*b*. That is, the signal lines 194 which transfer signals with voltages which are lower than the driving signals COM-A and COM-B are provided in the first flexible flat cable 190*a* and the second flexible flat cable 190*b* between the driving signal lines 194D and the signal lines 194 which are positioned on the ends (on the ends in the short-side direction). Accordingly, according to the liquid discharge apparatus 1 of the third embodiment, it is difficult for damage to occur and it is possible for the effect on the circuits to be reduced since a large voltage would not be applied to circuits such as the discharge selecting section 70 even if liquid were to reach the signal output terminals 195*a* and 195*b* which are farthest to the ends (the ground signal output terminals) in the first flexible flat cable 190*a* and the second flexible flat cable 190*b* and there were short circuiting of the ground line and the other signal lines 194 which transfer signals with low voltages which are close to the ground line.

4. Fourth Embodiment

In the liquid discharge apparatus 1 of the first embodiment, the second embodiment, and the third embodiment, there is a concern that, in a case where there was short circuiting which is caused by liquid which is discharged, erroneous discharge, malfunctioning of circuits in inner sections of the head unit 20, and the like would be generated if the various types of signals are continuously supplied to the head unit 20 in this state. Therefore, the liquid discharge apparatus 1 of a fourth embodiment has a configuration in the same manner as the liquid discharge apparatus 1 of the first embodiment, the second embodiment, and the third embodiment and also has a configuration where the supply of various types of signals from the control unit 10 to the head unit 20 is stopped in a case of short circuiting of the signal lines 194 of the flexible flat cable 190.

Figure 18:
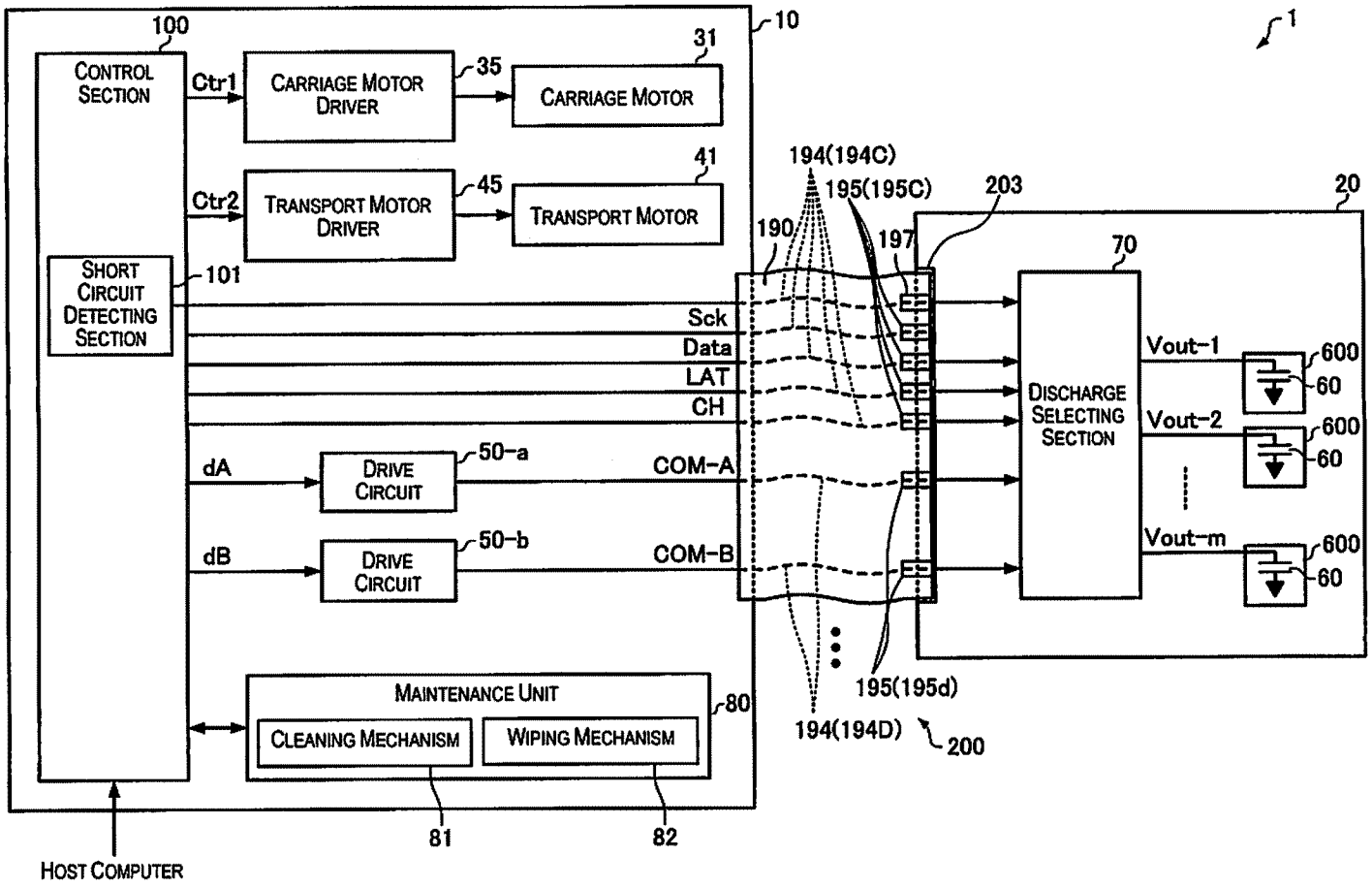
FIG. 18 is a block diagram illustrating an electrical configuration of a liquid discharge apparatus of a fourth embodiment.

FIG. 18 is a block diagram illustrating an electrical configuration of the liquid discharge apparatus 1 of the fourth embodiment. The same reference numerals are given to the constituent elements in FIG. 18 which are the same as the first embodiment, the second embodiment, and the third embodiment and the description which overlaps with the first embodiment, the second embodiment, and the third embodiment is omitted. As shown in FIG. 18, the flexible flat cable 190 in the liquid discharge apparatus 1 of the fourth embodiment includes a short circuit detecting terminal 197 for detecting short circuiting. In addition, the control section 100 includes a short circuit detecting section 101 which detects short circuiting based on the short circuit detecting terminal 197. Then, when the short circuit detecting section 101 detects short circuiting, supply of the driving signals (the driving signals COM-A and COM-B) and the control signals (the clock signal Sck, the data signal Data, the control signals LAT and CH, and the like) from the control unit 10 to the head unit 20 is stopped.

Figure 19:
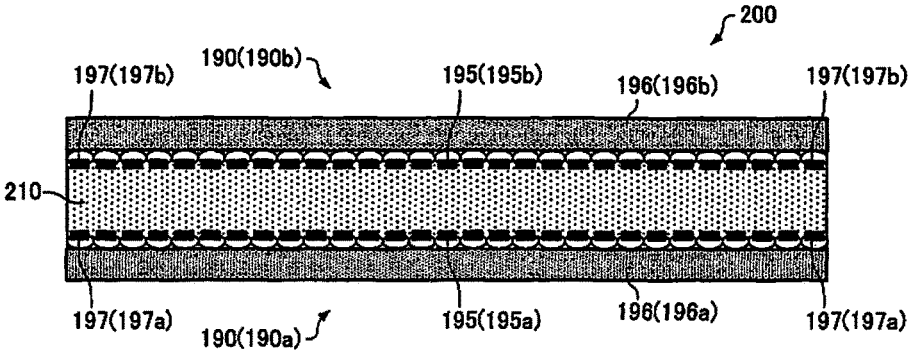
FIG. 19 is a diagram illustrating an end section of a flexible flat cable grouping in the fourth embodiment.

FIG. 19 is a diagram illustrating an end section (the end section on the side which is connected to the head unit 20) of the flexible flat cable grouping 200 in the fourth embodiment. The same reference numerals are given to the constituent elements in FIG. 19 which are the same as the first embodiment, the second embodiment, and the third embodiment and the description which overlaps with the first embodiment, the second embodiment, and the third embodiment is omitted.

As shown in FIG. 19, the first flexible flat cable 190*a* is provided with a short circuit detecting terminal 197*a* on the first surface 191*a*. The positioning and number of the short circuit detecting terminal 197*a* on the first surface 191*a* is arbitrary, but two of the short circuit detecting terminals 197*a* are preferably provided on both ends as shown in FIG. 19 since, as described above, it is easy for liquid to reach both ends at the end sections of the first flexible flat cable 190*a*. In the same manner, the second flexible flat cable 190*b* is provided with a short circuit detecting terminal 197*b* on the first surface 191*b*. The positioning and number of the short circuit detecting terminal 197*b* on the first surface 191*b* is arbitrary, but two of the short circuit detecting terminals 197*b* are preferably provided on both ends as shown in FIG. 19 since, as described above, it is easy for liquid to reach both ends at the end sections of the second flexible flat cable 190*b*.

For example, the short circuit detecting section 101 supplies a certain voltage to the signal line 194 which is connected to the short circuit detecting terminal 197*a* and monitors the voltage at the signal line 194, and also supplies a certain voltage to the signal line 194 which is connected to the short circuit detecting terminal 197*b* and monitors the voltage at the signal line 194. Since there is a change in the voltage of the signal line 194 which is connected to the short circuit detecting terminal 197*a* in a case where the short circuit detecting terminal 197*a* short circuits the signal output terminal 195*a*, it is possible for the short circuit detecting section 101 to detect the short circuiting by monitoring the voltage at the signal line 194. In the same manner, since there is a change in the voltage of the signal line 194 which is connected to the short circuit detecting terminal 197*b* in a case where the short circuit detecting terminal 197*b* short circuits the signal output terminal 195*b*, it is possible for the short circuit detecting section 101 to detect the short circuiting by monitoring the voltage of the signal line 194.

Then, in a case where the short circuit detecting section 101 detects the short circuiting of the short circuit detecting terminal 197*a* or the short circuit detecting terminal 197*b*, the control section 100 stops output of the driving signals (the driving signals COM-A and COM-B) and stops output of the control signals (the clock signal Sck, the data signal Data, the control signals LAT and CH, and the like) by controlling the drive circuits 50-*a* and 50-*b*.

The signal output terminal 195*a* may be also used as the short circuit detecting terminal 197*a*. In the same manner, the signal output terminal 195*b* may be also used as the short circuit detecting terminal 197*b*. A case is considered where allocation of the signals to the signal output terminal 195*a* of the first flexible flat cable 190*a* and allocation of the signals to the signal output terminal 195*b* of the second flexible flat cable 190*b* are as shown in FIG. 17. In this case, since the ground voltage which is a certain voltage is output from the signal output terminals 195*a* and the signal output terminals 195*b* with the terminal numbers 1 and 29, it is possible for the signal output terminals 195*a* and the signal output terminals 195*b* to also be used as the short circuit detecting terminals 197*a* and the short circuit detecting terminals 197*b*. In addition, the clock signal Sck is output from the signal output terminals 195*a* and the signal output terminals 195*b* with the terminal numbers 2 and 28 which are adjacent to the signal output terminals 195*a* and the signal output terminals 195*b* with the terminal numbers 1 and 29. Accordingly, when short circuiting occurs between these two adjacent terminals due to liquid which enters into the first connection section 203*a* or the second connection section 203*b* of the head unit 20, there is a change in the voltage at the signal lines 194 which are connected to the signal output terminals 195*a* with the terminal numbers 1 and 29 and at the signal lines 194 which are connected to the signal output terminals 195*b* with the terminal numbers 1 and 29 to match with the cycle of the clock signal Sck. It is possible for the short circuit detecting section 101 to detect short circuiting by binding the changes in voltage.

Here, the short circuit detecting section 101 is provided in the control unit 10 in FIG. 18 but may be provided in the head unit 20. In addition, it may be the case that the short circuit detecting terminal 197*a* is provided in the first flexible flat cable 190*a* but the short circuit detecting terminal 197*b* is not provided in the second flexible flat cable 190*b*. On the other hand, it may be the case that the short circuit detecting terminal 197*b* is provided in the second flexible flat cable 190*b* but the short circuit detecting terminal 197*a* is not provided in the first flexible flat cable 190*a*.

According to the liquid discharge apparatus 1 of the fourth embodiment, it is possible to suppress erroneous discharge and malfunctioning of circuits in inner sections of the head unit 20 since the driving signals (the driving signals COM-A and COM-B) which are high voltages and the control signals (the clock signal Sck, the data signal Data, the control signals LAT and CH, and the like) which control discharging using the discharge sections 600 are no longer supplied to the head unit 20 in a case where the short circuit detecting section 101 detects short circuiting.

5. Modified Examples

The reinforcing plate 196*a* is provided in the second surface 192*a* of the first flexible flat cable 190*a* in each of the embodiments described above, but the reinforcing plate 196*a* need not be provided. In the same manner, the reinforcing plate 196*b* is provided in the second surface 192*b* of the second flexible flat cable 190*b* in each of the embodiments described above, but the reinforcing plate 196*b* need not be provided.

In addition, the plurality of signal input terminals 205*b* are provided on the lower surface of the open section in the second connection section 203*b* of the head unit 20 in each of the embodiments described above, but the plurality of signal input terminals 205*b* may be provided on the upper surface of the open section. That is, the first surface 191*a* of the first flexible flat cable 190*a* and the second surface 192*b* of the second flexible flat cable 190*b* may oppose each other and the liquid absorbing member 210 may be provided between the first surface 191*a* and the second surface 192*b* in the flexible flat cable grouping 200.

In addition, the flexible flat cable grouping 200 may be a configuration where the arrangement of the first flexible flat cable 190*a* and the second flexible flat cable 190*b* is switched and the arrangement of the first connection section 203*a* and the second connection section 203*b* in the head unit 20 is switched. That is, the first connection section 203*a* which is connected to the first flexible flat cable 190*a* need not be positioned to be closest to the discharge surface 20X of the head unit 20.

In addition, the flexible flat cable grouping 200 includes two of the flexible flat cables 190 (the first flexible flat cable 190*a* and the second flexible flat cable 190*b*) in each of the embodiments described above, but may include three or more of the flexible flat cables 190.

Embodiments and modified examples are described above, but the present invention is not limited to these embodiments or modified examples, and it is possible to realize various aspects within a range which does not depart from the gist of the present invention. For example, it is possible to appropriately combine each of the embodiments and each of modified examples described above.

The present invention includes configurations which are substantially the same as the configurations which are described in the embodiments (for example, configurations where the functions, the methods, and the results are the same and configurations where the objectives and the results are the same). In addition, the present invention includes configurations where a portion, which is not essential to the configurations which are described in the embodiments, is replaced. In addition, the present invention includes configurations which deliver the same operational effects as the configurations which are described in the embodiments and configurations where it is possible for the same objectives as the configurations which are described in the embodiments to be achieved. In addition, the present invention includes configurations where common techniques are added to the configurations which are described in the embodiments.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:
a first flexible flat cable;
a second flexible flat cable;
a head unit; and
a liquid absorbing member,
the head unit including a discharge section which discharges a liquid due to driving signals being applied, a discharge surface which is provided with a discharge opening for discharging the liquid, a first connection section which is connected to the first flexible flat cable, and a second connection section which is connected to the second flexible flat cable, and
the liquid absorbing member being provided between the first flexible flat cable and the second flexible flat cable such that the liquid absorbing member contacts a surface of the first flexible flat cable and a surface of the second flexible flat cable.

2. The liquid discharge apparatus according to claim 1,
wherein each of the first flexible flat cable and the second flexible flat cable includes a first surface, a second surface which is on the reverse side of the first surface, a driving signal line which transfers the driving signals, and a driving signal output terminal which is provided in the first surface and which outputs the driving signals to the head unit,
the first surface of the first flexible flat cable and the first surface of the second flexible flat cable oppose each other, and
the liquid absorbing member is provided between the first surface of the first flexible flat cable and the first surface of the second flexible flat cable.

3. The liquid discharge apparatus according to claim 2,
wherein the head unit includes a discharge selecting section which selects the discharge section which is to discharge the liquid by receiving control signals, and
each of the first flexible flat cable and the second flexible flat cable includes a control signal line which transfers the control signals and a control signal output terminal which is provided in the first surface and which outputs the control signals to the head unit.

4. The liquid discharge apparatus according to claim 2,
wherein the first flexible flat cable is connected to the first connection section so that the second surface faces toward the same side as the discharge surface.

5. The liquid discharge apparatus according to claim 4,
wherein the first flexible flat cable is connected to the first connection section so that it is easier for mist, which is generated in accompaniment with the liquid being discharged from the discharge opening, to become attached to the second surface than to the first surface.

6. The liquid discharge apparatus according to claim 4, further comprising:
a plurality of flexible flat cables which include the first flexible flat cable and the second flexible flat cable,
wherein the head unit includes a plurality of connection sections which include the first connection section and the second connection section,
the plurality of flexible flat cables are respectively connected to the plurality of connection sections, and
the first connection section is the closest out of the plurality of connection sections to the discharge surface.

7. The liquid discharge apparatus according to claim 4,
wherein the first flexible flat cable includes a reinforcing plate which is provided on the second surface.

8. The liquid discharge apparatus according to claim 7,
wherein the reinforcing plate has an ability to repeal water which is greater than the second surface of the first flexible flat cable.

9. The liquid discharge apparatus according to claim 7,
wherein the reinforcing plate does not have grooves.

10. The liquid discharge apparatus according to claim 4,
wherein at least one of the first flexible flat cable and the second flexible flat cable includes a short circuit detecting terminal which is provided in the first surface in order to detect short circuiting.

11. The liquid discharge apparatus according to claim 10, further comprising:
a short circuit detecting section which detects short circuiting based on the short circuit detecting terminal,
wherein supply of the driving signals to the head unit is stopped when the short circuit detecting section detects the short circuiting.

12. The liquid discharge apparatus according to claim 11,
wherein supply of the control signals to the head unit is stopped when the short circuit detecting section detects the short circuiting.

13. The liquid discharge apparatus according to claim 4,
wherein the first flexible flat cable and the second flexible flat cable include a plurality of signal lines, and
the driving signal line is a signal line out of the plurality of signal lines other than the signal lines which are positioned on the ends.

14. The liquid discharge apparatus according to claim 13,
wherein the signal lines which are positioned on the ends are ground lines.

15. The liquid discharge apparatus according to claim 13,
wherein a signal line which transfers a signal with a voltage which is lower than the driving signal is provided between the driving signal line and the signal lines which are positioned at the ends.

16. The liquid discharge apparatus according to claim 2,
wherein the driving signal output terminal is not provided in the second surface of the first flexible flat cable and the second surface of the second flexible flat cable.

17. The liquid discharge apparatus according to claim 1, further comprising:

a binding section for binding the first flexible flat cable and the second flexible flat cable.

18. The liquid discharge apparatus according to claim 1, wherein the head unit discharges the liquid while sliding.

19. A flexible flat cable grouping, which is connected to a first connection section and a second connection section of a head unit which includes a discharge section which discharges a liquid due to driving signals being applied, a discharge surface which is provided with a discharge opening for discharging the liquid, the first connection section, and the second connection section, comprising:

a first flexible flat cable;

a second flexible flat cable; and a liquid absorbing member, the liquid absorbing member being provided between the first flexible flat cable and the second flexible flat cable such that the liquid absorbing member contacts a surface of the first flexible flat cable and a surface of the second flexible flat cable.

20. The flexible flat cable grouping according to claim 19, wherein each of the first flexible flat cable and the second flexible flat cable include a first surface, a second surface which is on the reverse side of the first surface, a driving signal line which transfers the driving signals, and a driving signal output terminal which is provided in the first surface and which outputs the driving signals to the head unit, the first surface of the first flexible flat cable and the first surface of the second flexible flat cable oppose each other, and the liquid absorbing member is provided between the first surface of the first flexible flat cable and the first surface of the second flexible flat cable.

21. The flexible flat cable grouping according to claim 20, wherein each of the first flexible flat cable and the second flexible flat cable include a control signal line which transfers control signals for controlling a discharge selecting section, which is included in the head unit and which selects the discharge section which is to discharge the liquid, and a control signal output terminal which is provided in the first surface and which outputs the control signals to the head unit.

22. The flexible flat cable grouping according to claim 20, wherein the first flexible flat cable is connected to the first connection section so that the second surface faces toward the same side as the discharge surface.

23. The flexible flat cable grouping according to claim 22, wherein the first flexible flat cable is connected to the first connection section so that it is easier for mist, which is generated in accompaniment with the liquid being discharged from the discharge opening, to become attached to the second surface than to the first surface.

24. The flexible flat cable grouping according to claim 22, wherein the first flexible flat cable is connected to the connection section which is the closest, out of a plurality of connection sections which are included in the head unit and which include the first connection section and the second connection section, to the discharge surface.

25. The flexible flat cable grouping according to claim 22, wherein the first flexible flat cable includes a reinforcing plate which is provided on the second surface.

26. The flexible flat cable grouping according to claim 25, wherein the reinforcing plate has an ability to repeal water which is greater than the second surface of the first flexible flat cable.

27. The flexible flat cable grouping according to claim 25, wherein the reinforcing plate does not have grooves.

28. The flexible flat cable grouping according to claim 22, wherein at least one of the first flexible flat cable and the second flexible flat cable includes a short circuit detecting terminal which is provided in the first surface in order to detect short circuiting.

29. The flexible flat cable grouping according to claim 22, wherein the first flexible flat cable and the second flexible flat cable include a plurality of signal lines, and the driving signal line is a signal line out of the plurality of signal lines other than the signal lines which are positioned on the ends.

30. The flexible flat cable grouping according to claim 29, wherein the signal lines which are positioned on the ends are ground lines.

31. The flexible flat cable grouping according to claim 29, wherein a signal line which transfers a signal with a voltage which is lower than the driving signal is provided between the driving signal line and the signal lines which are positioned at the ends.

32. The flexible flat cable grouping according to claim 20, wherein the driving signal output terminal is not provided in the second surface of the first flexible flat cable and the second surface of the second flexible flat cable.

33. The flexible flat cable grouping according to claim 19, further comprising:

a binding section for binding the first flexible flat cable and the second flexible flat cable.

* * * * *